United States Patent [19]

Langenbeck

[11] Patent Number: 4,872,560

[45] Date of Patent: Oct. 10, 1989

[54] TRAY FOR STORING AND TRANSPORTING BEVERAGE CONTAINERS AND THE LIKE

[76] Inventor: Keith A. Langenbeck, 4005 University Blvd., Dallas, Tex. 75205

[21] Appl. No.: 76,295

[22] Filed: Jul. 22, 1987

Related U.S. Application Data

[63] Continuation-in-part of Ser. No. 30,899, Mar. 26, 1987.

[51] Int. Cl.[4] ..... B65D 1/34

[52] U.S. Cl. ..... 206/557; 220/DIG. 15

[58] Field of Search ..... 220/72, 74, DIG. 15, 220/DIG. 14, 21; 206/203, 557, 427, 139, 566

[56] References Cited

U.S. PATENT DOCUMENTS

| | | | |
|---|---|---|---|
| D. 98,200 | 1/1936 | Worthington | 220/21 X |
| D. 150,031 | 6/1948 | Richards | 220/21 X |
| 2,758,742 | 8/1956 | Farrell | 220/210 R |

FOREIGN PATENT DOCUMENTS

| | | | |
|---|---|---|---|
| 1400377 | 4/1965 | France | 220/21 |

OTHER PUBLICATIONS

Modern Plastics, Aug. 1963, pp. 78–83 and 172.

*Primary Examiner*—William Price
*Attorney, Agent, or Firm*—W. Kirk McCord

[57] ABSTRACT

A tray for storing and transporting a plurality of cylindrically-shaped articles, such as beverage containers, in a stable, upright position is provided. The tray is comprised of a bottom member and four walls extending upwardly therefrom and interconnected to form an enclosure for receiving the articles. A plurality of rib members are disposed on respective inner surfaces of the walls of the tray. Selected ones are arranged in cooperating pairs to define respective recessed regions therebetween. Each of the cooperating pairs of rib members contacts a corresponding one of the articles at respective positions on the curved surfaces thereof so that a predetermined portion of each article is received within the corresponding recessed region and at least a portion of the curved surface of the article is in contact with the corresponding wall within the recessed region, thereby retaining the articles in a substantially upright position within the tray. The respective outer surfaces of the walls and the bottom member are substantially smooth to enhance the structural integrity of the tray.

10 Claims, 19 Drawing Sheets

TRAY FOR STORING AND TRANSPORTING BEVERAGE CONTAINERS AND THE LIKE

This is a continuation-in-part of Applicant's copending application Ser. No. 030,899, filed Mar. 26, 1987.

FIELD OF THE INVENTION

The present invention relates generally to storage and transport trays and in particular to a tray for storing and transporting beverage containers and the like.

BACKGROUND OF THE INVENTION

Beverages, such as soft drinks and beer, are distributed commercially in glass and plastic bottle and in aluminum cans. Single service beverage containers, which typically contain six to twenty-four ounces of the beverage, are grouped into individual cases, each of which contains twenty-four individual containers. These cases may be further subdivided into groups of six, eight or twelve individual beverage container packages. Typically, each case of individual containers or multiple container packages is loaded by an automated tray packing system into a separate tray for transport from the site of a bottling company to the point of sale, such as at a grocery store.

DESCRIPTION OF THE PRIOR ART

According to prior practice, trays used for transporting beverage containers are made of corrugated paper or wood. Corrugated paper trays are typically rectangular in shape, with upright walls around the perimeter of the tray. Thus, the beverage containers must be loaded vertically into the tray, which is a relatively slow and complex process. Alternatively, if the containers are loaded into the corrugated paper tray when the tray is disposed at an angle relative to the incoming containers, the volume of the tray must be substantially greater than the volume occupied by the containers when the containers are loaded into the tray, thereby resulting in excessive free play or "slop" among the containers in the tray after loading.

Another problem associated with corrugated paper trays is their lack of durability. Such trays are usually discarded after one trip from the bottling company to the point of sale. Because these trays are "non-returnable", the cost of the bottling operation is increased by approximately $0.07 per tray, which can be substantial for a large bottling company shipping millions of beverage cases per year.

Wood trays are typically of older design and are more suitable for transporting bottles than cans. Such wood trays may have individual rectangular compartments within the tray for receiving an individual bottle. Because of the thickness of the wooden partitions between compartments, such wooden trays are typically used only to transport individual bottles and not beverage containers which have been pre-packaged or prewrapped into groups of six, eight or twelve individual containers. Because the spacing between individual containers is different when wooden transport trays are used instead of corrugated paper trays, the automatic tray packing system must be adjusted for a different setting, which complicates and slows down the packing process. Although wood transport trays are returnable, they have vertically upright walls, which prevent them from being "nested" together to save storage space.

OBJECTS OF THE INVENTION

It is, therefore, the principal object of the invention to provide an improved tray for storing and transporting beverage containers and the like.

Another object of the invention is to provide a more cost effective tray for storing and transporting beverage containers.

Still another object of the invention is to provide a lightweight, yet sturdy tray for storing and transporting beverage containers.

Yet another object of the invention is to provide a returnable tray for storing and transporting beverage containers.

A further object of the invention is to provide a tray which is suitable for storing and transporting beverage containers in a loose state or in multi-container packages.

Still a further object of the invention is to provide beverage storing and transport trays which are nestable with one another.

SUMMARY OF THE INVENTION

These and other objects are accomplished in accordance with the present invention wherein a tray for storing and transporting a plurality of cylindrically-shaped articles in a substantially upright position is provided. The tray is comprised of a bottom member, a pair of oppositely positioned first and second side walls extending longitudinally along the tray and a pair of oppositely positioned first and second end walls extending transversely across the tray, which are interconnected to define an enclosure for receiving the articles. The tray further includes a plurality of structural members disposed on respective inner surfaces thereof for enhancing the structural strength and integrity of the tray. In one aspect of the invention, the respective outer surfaces of the tray are substantially solid to further enhance the structural integrity of the tray.

In one embodiment, the first and second end walls are comprised of a first plurality of recessed regions separated by the corresponding one of a plurality of inwardly extending surfaces to provide a substantially scalloped appearance on the end walls. The end wall surface within each region is curved to conform to the curved surface of the corresponding article so that substantially the entire curved surface of the portion of the article which is disposed within the recessed region is in contact with the end wall surface within each region. The first and second side walls have respective first and second sets of rib members extending vertically along substantially the entire height of the respective side walls and partially inwardly along the bottom member on respective inner surfaces thereof. Selected ones of the first and second sets of rib members are arranged in cooperating pairs to define a second plurality of recessed regions therebetween.

In another embodiment of the invention the aforementioned structural members are comprised of first, second and third sets of rib members disposed on respective inner surfaces of the tray. The first set of rib members extend vertically at least partially along the height of the first side wall, transversely across the bottom member and vertically at least partially along the height of the second side wall. The second and third sets of rib members extend vertically at least partially along the heights of the respective first and second end walls and partially inwardly along the bottom member and terminating at respective intersections on the bottom members with respective ones of the first set of rib members which are closest to the respective first and second end walls. Selected ones of the first, second and third sets of rib members are arranged in cooperating pairs to define respective recessed regions therebetween, each of the cooperating pairs for contacting a corresponding one of the articles at respective positions on the curved surfaces thereof so that a predetermined portion of each article is received within the corresponding recessed region and at least a portion of the curved surface of the article is in contact with the corresponding wall within the recessed region, thereby retaining the articles in a substantially upright position within the tray.

In yet another embodiment of the invention the tray includes a first set of rib members extending vertically at least partially along the height of the first end wall, longitudinally along the bottom member and vertically at least partially along the height of the second end wall on respective inner surfaces thereof. Second and third sets of rib members extend vertically at least partially along the heights of the respective first and second side walls and partially inwardly across the bottom member on respective inner surfaces thereof and terminating at respective intersections on the bottom member with respective ones of the first set of rib members which are closest to the respective first and second side walls. Selected ones of the first, second and third sets of rib members are arranged in cooperating pairs to define a plurality of recessed regions therebetween, each of the cooperating pairs for contacting a corresponding one of the articles at respective positions on the curved surfaces thereof so that a predetermined portion of each article is received within the corresponding recessed region and at least a portion of the curved surface of the article is in contact with the corresponding wall within the recessed region.

BRIEF DESCRIPTION OF THE DRAWINGS

Still further objects and advantages of the invention will be apparent from the detailed description and claims when read in conjunction with the accompanying drawings wherein:

DETAILED DESCRIPTION OF THE PREFERRED EMBODIMENT

Figure 1:
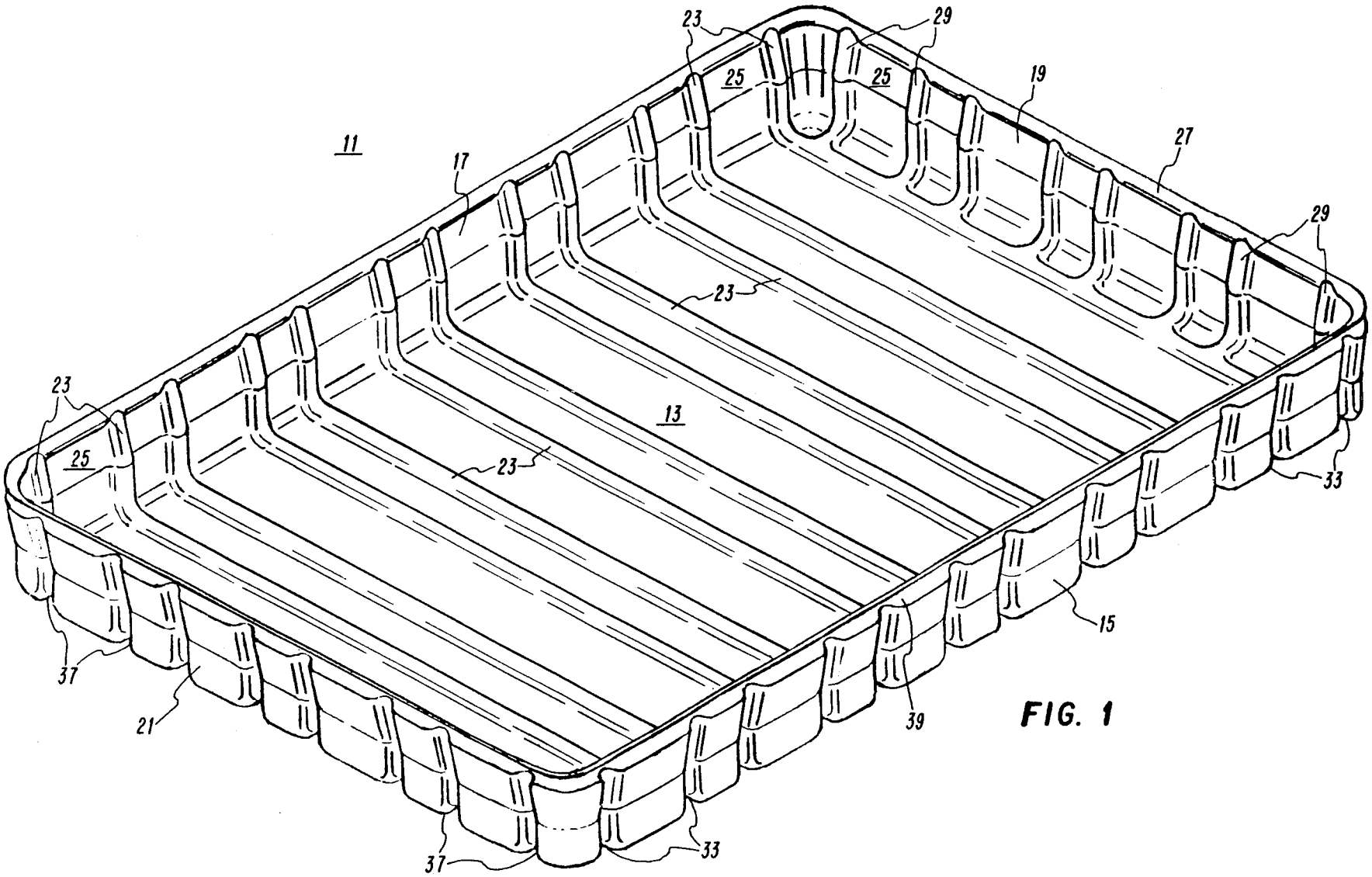
FIGS. 1–4 are perspective, side elevation, end elevation and top plan views, respectively, of a first embodiment of a tray for storing and transporting beverage containers and the like, according to the present invention.

In the description which follows, like parts are marked throughout the specification and drawings, respectively. The drawings are not necessarily to scale and in some instances proportions have been exaggerated in order to more clearly depict certain features of the invention.

Referring to FIGS. 1–4, a first embodiment of a storage and transport tray 11 according to the present invention is depicted. Tray 11 is comprised of a bottom member 13, a pair of oppositely positioned side walls 15 and 17 and a pair of oppositely positioned end walls 19 and 21, interconnected to form an enclosure for receiving articles therein. The respective intersections between adjacent ones of the tray walls and between each of the walls and bottom member 13 define respective curved surfaces to provide respective areas of transition therebetween, thereby enhancing the strength and rigidity of tray 11.

Disposed on respective inner surfaces of side walls 15 and 17 and on bottom member 13 are a first set of rib members 23. First rib members 23 are arranged in cooperating pairs to define respective recessed regions 25 therebetween. The spacings between adjacent ones of rib members 23 are dependent upon the thickness of rib members 23 (measured perpendicularly inward from the respective side walls 15 and 17) and the diameter of the container. The greater the thickness of rib members 23, the greater will be the spacings between adjacent ones of the rib members, so that cylindrically-shaped articles, such as beverage containers, stored in tray 11 are able to contact the respective side walls 15 and 17 within the respective recessed regions 25, as will be described in greater detail with reference to FIGS. 28–31.

First rib members 23 extend substantially along the entire height of side wall 15, transversely across bottom member 13 and substantially along the entire height of opposite side wall 17 and terminate at respective intersections with a perimeter rim member 27, which is disposed adjacent to the upper edge of tray 11. Rim member 27 extends inwardly from each of the walls of tray 11 along the perimeter thereof, to enhance the structural strength and rigidity of the upper edges of tray 11.

Figure 4:
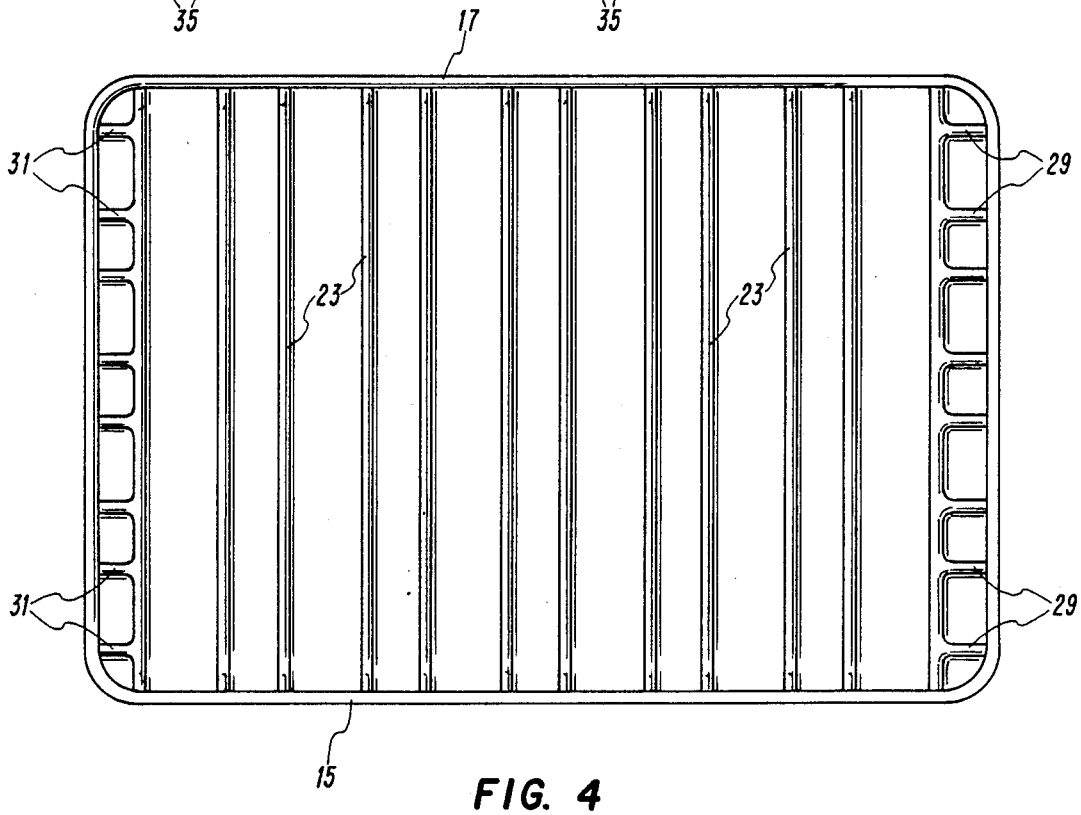

A second set of rib members 29 is disposed on an inner surface of end wall 19 and extends substantially along the entire height of end wall 19 and partially inwardly along bottom member 13 and terminating at the respective intersections on bottom member 13 with the particular one of the first set of rib members 23 which is closest to end wall 19. A third set of rib members 31 is disposed on an inner surface of end wall 21 and extends substantially along the entire height of end wall 21 and partially inwardly along bottom member 13 and terminating at the respective intersections on bottom member 13 with the particular one of the first set of rib members 23 which is closest to end wall 21, as shown in FIG. 4.

Second and third rib members 29 and 31 are also arranged in respective cooperating pairs at predetermined locations on tray 11. Each of the cooperating pairs defines a corresponding one of a plurality of recessed regions 25 therebetween, in much the same manner as first rib members 23. The spacings between adjacent ones of rib member 29 and 31 along the respective end walls 19 and 21 are dependent upon the thickness of the rib members (measured perpendicularly inward from the respective end walls) and the diameter of the container. The greater the thickness of the rib members, the greater will be the spacing between adjacent ones of rib members 29 and 31, so that cylindrically-shaped articles, such as beverage containers, stored in tray 11 are able to contact the respective end walls 19 and 21 within the respective recessed regions 25, as will be described in greater detail with reference to FIGS. 28 and 31. One skilled in the art will appreciate that second and third rib members 29 and 31 are in effect a mirror image of one another.

Bottom member 13, side walls 15 and 17, end walls 19 and 21, rim member 27 and first, second and third rib members 23, 29 and 31 are preferably formed as an integral unit using a conventional thermoforming process. Tray 11 is preferably comprised of a lightweight, translucent plastic material. Each rib member of tray 11 forms a corresponding groove in the corresponding outer surface of tray 11. First rib members 23 form a corresponding first set of grooves 33 in the respective outer surfaces of side walls 15 and 17 and in bottom member 13. Second and third rib members 29 and 31 form corresponding second and third sets of grooves 35 and 37 in respective outer surfaces of end walls 19 and 21 and in bottom member 13. Rim member 27 forms a corresponding groove 39 in the respective outer surfaces around the perimeter of tray 11.

Figure 2:
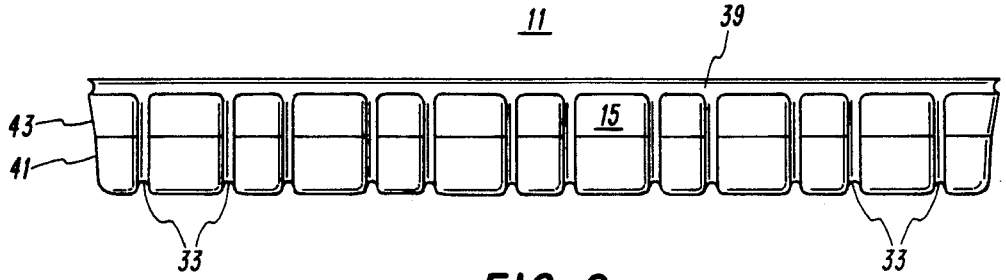
Figure 3:
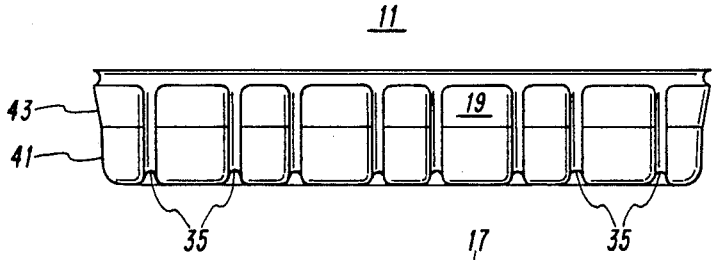

Tray 11 is particularly well-suited for storing and transporting cylindrically-shaped articles, such as beverage container bottles or cans, in a substantially upright position, without excessive free play or "slop" of the beverage containers within tray 11. Side walls 15 and 17 and end walls 19 and 21 are preferably "compound" walls, the respective lower portions 41 of which are oriented substantially vertically and the respective upper portions 43 of which are angled outwardly with respect to lower portions 41 (as best seen in FIGS. 2 and 3), to provide a predetermined draft angle to facilitate loading of beverage containers into tray 11, as will be described in greater detail with reference to FIGS. 25–31.

Figure 5:
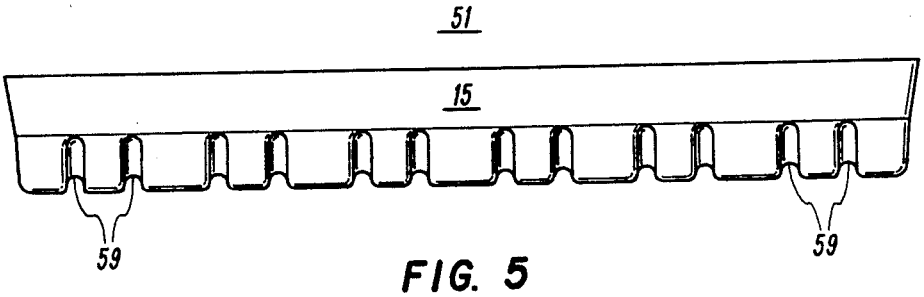
FIGS. 5–7 are side elevation, end elevation and top plan views, respectively, of a second embodiment of the tray, according to the present invention.
Figure 6:
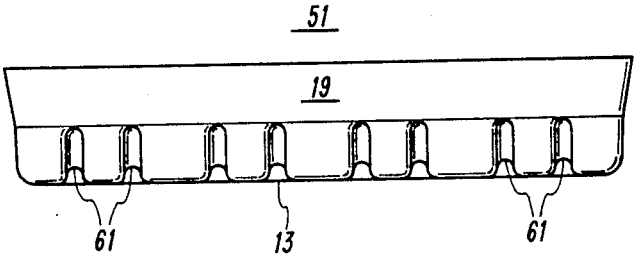
Figure 7:
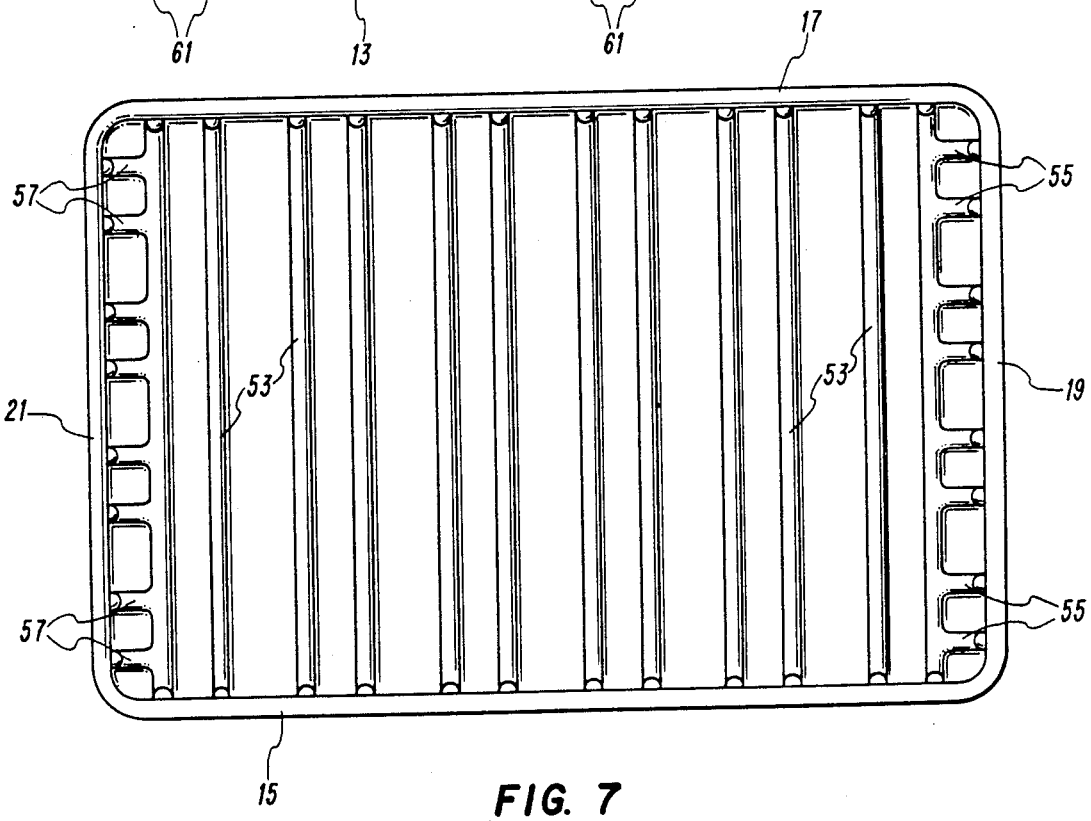

Referring to FIGS. 5–7, a second embodiment of a tray 51 according to the present invention is depicted. Tray 51 is substantially the same as tray 11, described above with reference to FIGS. 1–4, except that first, second and third sets of rib members 53, 55 and 57 extend only partially upward along respective side walls 15 and 17 and end walls 19 and 21 and container 51 contains no perimeter rim member, as best seen in FIGS. 5 and 6. First, second and third sets of rib members 53, 55 and 57 preferably extend vertically along substantially the entire height of the respective lower portions 41 of the compound walls of tray 51 and terminate at or adjacent to the area of transition between the respective lower portions 41 and upper portions 43 of the tray walls, as best seen in FIGS. 5 and 6. First, second and third rib members 53, 55 and 57 form corresponding first, second and third sets of grooves in the respective outer surfaces of tray 51. First and second sets of grooves 59 and 61 are illustrated in FIGS. 5 and 6.

Figure 8:
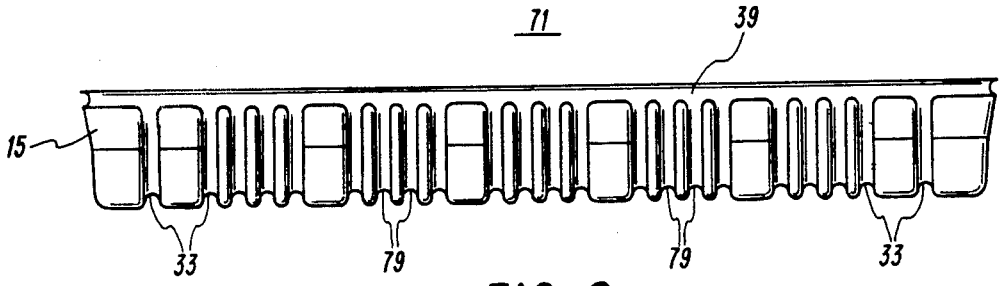
FIGS. 8–10 are side elevation, end elevation and top plan views, respectively, of a third embodiment of the tray, according to the present invention.
Figure 9:
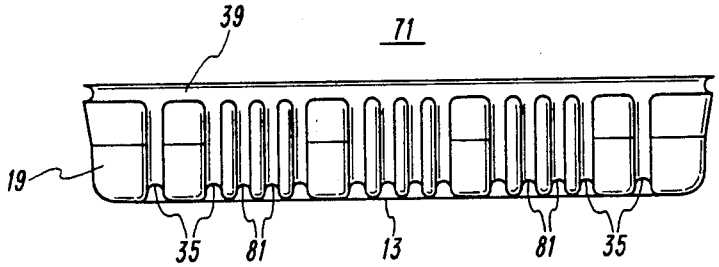
Figure 10:
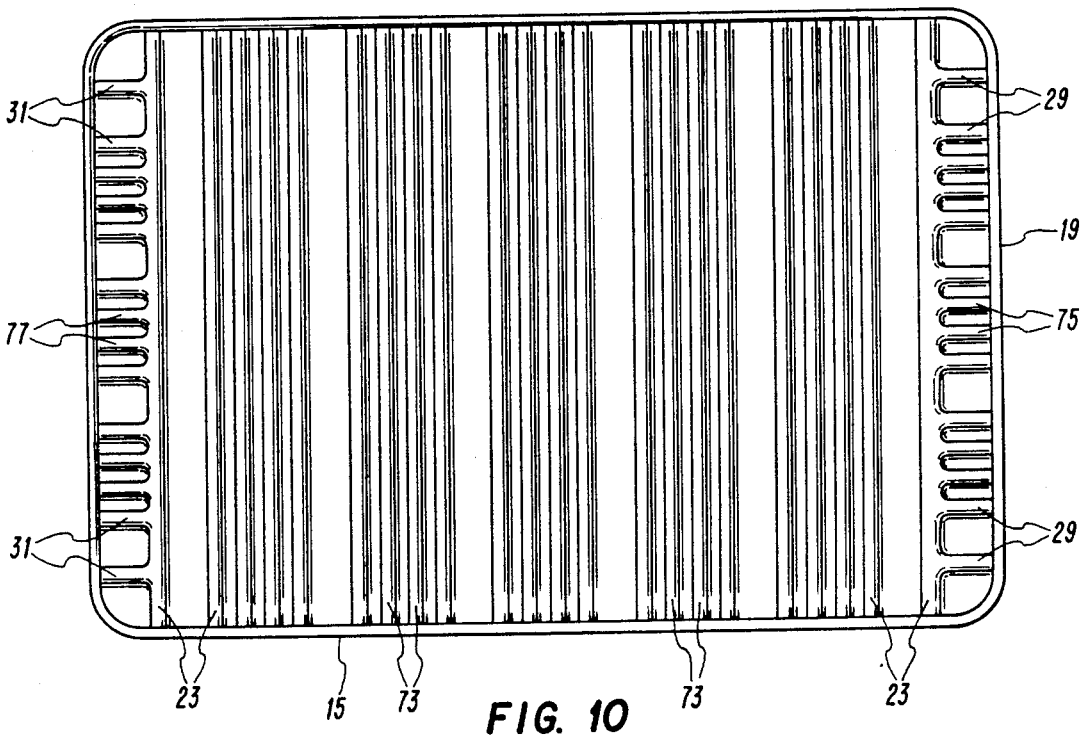

Referring to FIGS. 8–10 a third embodiment of a tray 71 according to the present invention is depicted. Tray 71 is substantially the same as tray 11 described above with reference to FIGS. 1–4, except that tray 71 further includes a fourth set of rib members 73 extending vertically along substantially the entire height of first side wall 15, transversely across bottom member 13 and vertically along substantially the entire height of second side wall 17, and fifth and sixth sets of rib members 75 and 77 extending vertically along substantially the entire height of respective first and second end walls 19 and 21 and partially inwardly along bottom member 13 and terminating at the respective intersections on bottom member 13 with respective ones of first rib members 23 which are closest to the respective first and second end walls 19 and 21. Fourth, fifth and sixth sets of rib members 73, 75 and 77 are disposed at substantially equal intervals between the respective adjacent cooperating pairs of rib members 23, 29 and 31 on the respective walls of tray 71. Fourth, fifth and sixth sets of rib members 73, 75 and 77 form corresponding fourth, fifth and sixth sets of grooves in the respective outer surfaces of tray 71. Fourth and fifth sets of grooves 79 and 81 are illustrated in FIGS. 8 and 9.

Figure 11:
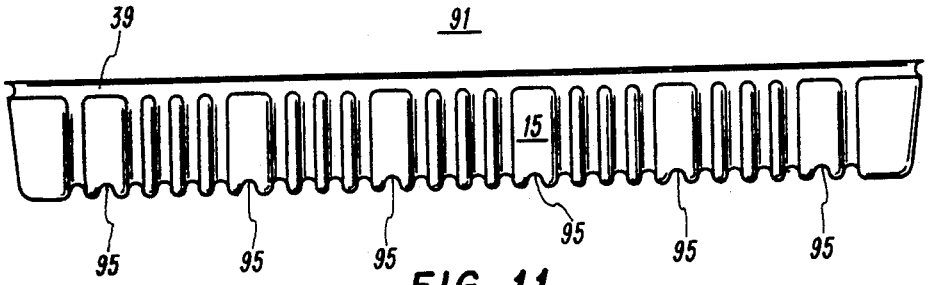
FIGS. 11–13 are side elevation, end elevation and top plan views, respectively, of a fourth embodiment of the tray, according to the present invention.
Figure 12:
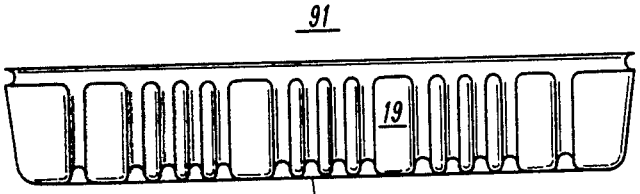
Figure 13:
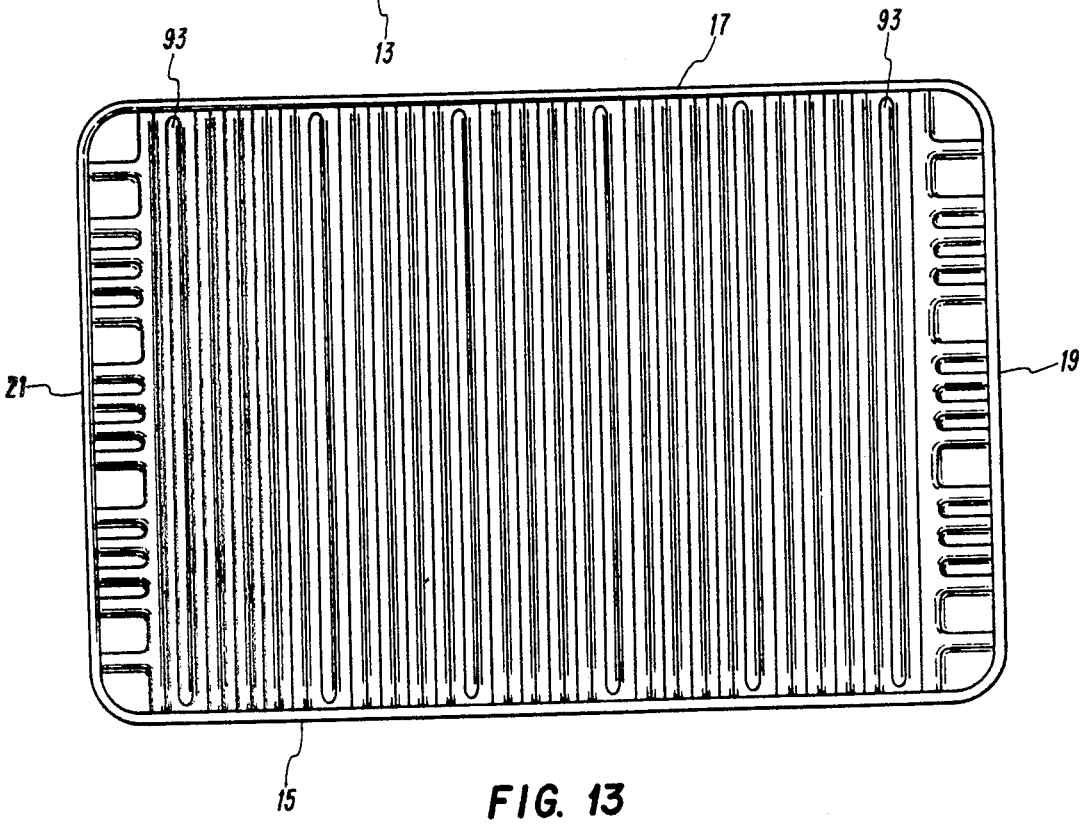
Figure 14:
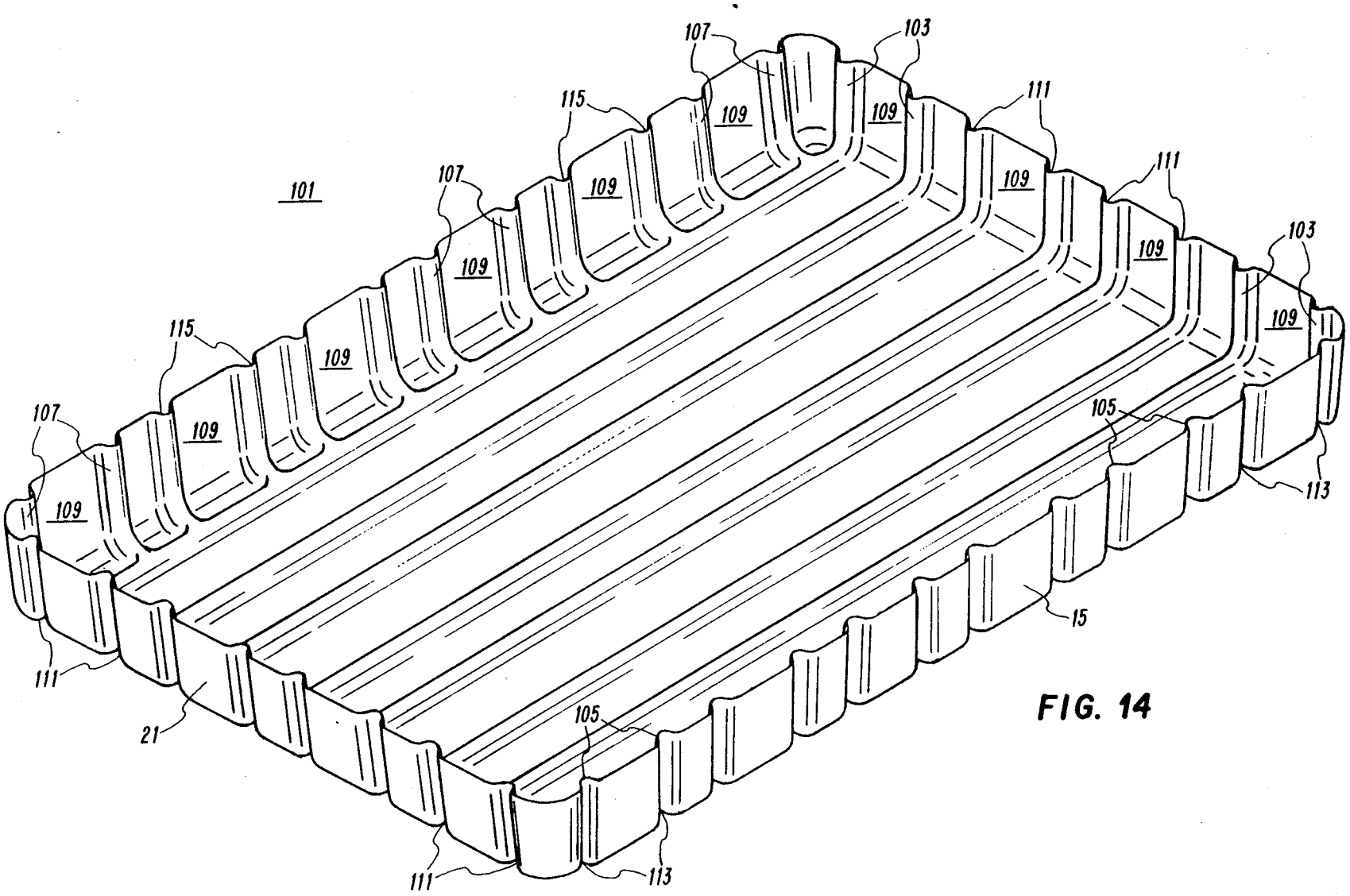
FIGS. 14–17 are perspective, side elevation, end elevation and top plan views, respectively, of a fifth embodiment of the tray, according to the present invention.
Figure 15:
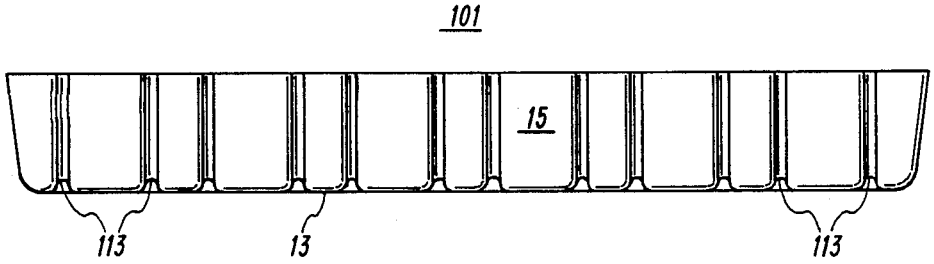
Figure 16:
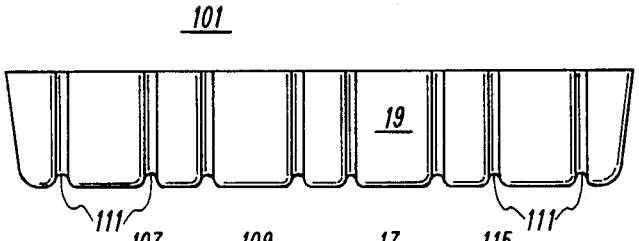
Figure 17:
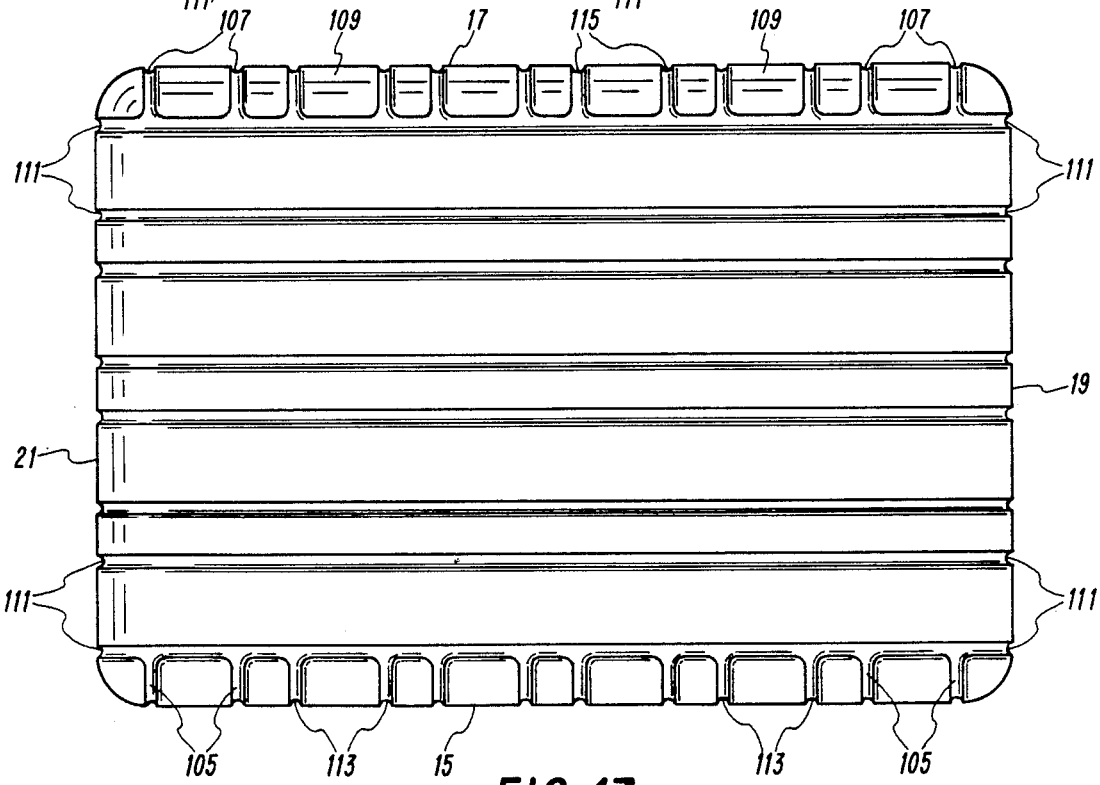

Referring to FIGS. 11–13, a fourth embodiment of a tray 91 according to the present invention is depicted. Tray 91 is substantially the same as tray 71 described above with reference to FIGS. 8–10, except that tray 91 further includes a seventh set of rib members 93 extending transversely across bottom member 13 between first and second side walls 15 and 17 and walls 15, 17, 19 and 21 are "single slope" walls (i.e., the walls have a relatively constant slope from bottom member 13 to rim member 17) instead of "compound" walls. Seventh rib members 93 do not extend vertically along the respective surfaces of side walls 15 and 17, but rather terminate at the respective intersections with side walls 15 and 17. Seventh set of rib members 93 are disposed between individual ones of each cooperating pair of first set of rib members 23, at substantially equal distances between individual rib members 23 of each cooperating pair, for dividing the corresponding recessed region 25 substantially in half along bottom member 13. Seventh set of rib members 93 form a corresponding seventh set of grooves 95 on the outer surface of bottom member 13, as best seen in FIG. 11.

Referring to FIGS. 14–17, a fifth embodiment of a tray 101 according to the present invention is depicted. Tray 101 has a first set of rib members 103 extending vertically along substantially the entire height of first end wall 19, longitudinally along bottom member 13 and vertically along substantially the entire height of second end wall 21. First rib members 103 terminate at the respective upper edges of first and second end walls 19 and 21.

Second and third sets of rib members 105 and 107 extend vertically along substantially the entire height of respective first and second side walls 15 and 17 and partially inwardly across bottom member 13 and terminate at the respective intersections on bottom member 13 with a particular one of first set of rib members 103 which is closest to the respective side walls 15 and 17.

First, second and third sets of rib members 103, 105 and 107 are arranged in respective cooperating pairs at predetermined locations on tray 101. Each of the cooperating pairs of rib members defines a corresponding one of a plurality of recessed regions 109 therebetween. The spacings between adjacent ones of rib members 103, 105 and 107 are dependent upon the thickness of the rib members (measured perpendicularly inward from the respective walls). The greater the thickness of the rib members, the greater will be the spacings between adjacent ones of the rib members, so that cylindrically-shaped articles, such as beverage containers, stored in tray 101 are able to contact the respective walls of tray 101 within the respective recessed regions 109, as described in greater detail with reference to FIGS. 28–31. First, second and third sets of rib members 103, 105 and 107 define respective first, second and third sets of grooves 111, 113 and 115 on the corresponding outer surfaces of tray 101.

Side walls 15 and 17 and end walls 19 and 21 are preferably angled outwardly with respect to a vertical axis which is perpendicular to bottom member 13, to provide a predetermined draft angle to facilitate loading of beverage containers into tray 101, as will be described in greater detail with reference to FIGS. 25–31. Bottom member 13, side walls 15 and 17, end walls 19 and 21 and first, second and third rib members 103, 105 and 107 are preferably formed as an integral unit using a convention thermoforming process. Tray 101 is preferably comprised of a lightweight plastic material.

Figure 18:
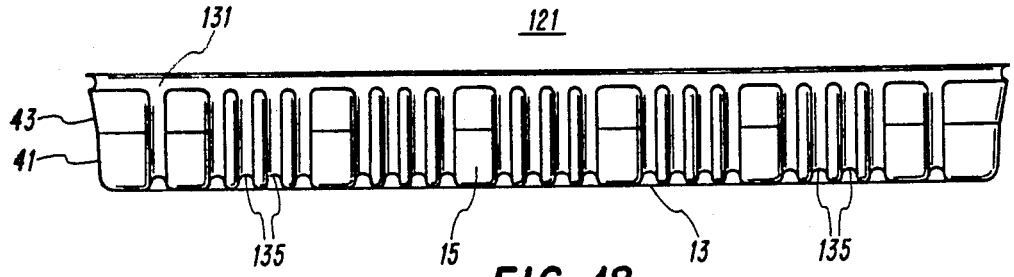
FIGS. 18–20 are side elevation, end elevation and top plan views, respectively, of a sixth embodiment of the tray, according to the present invention.
Figure 19:
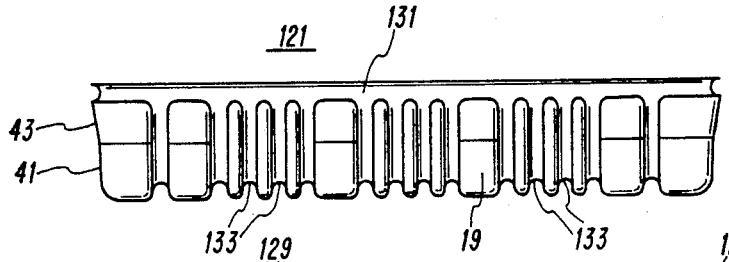
Figure 20:
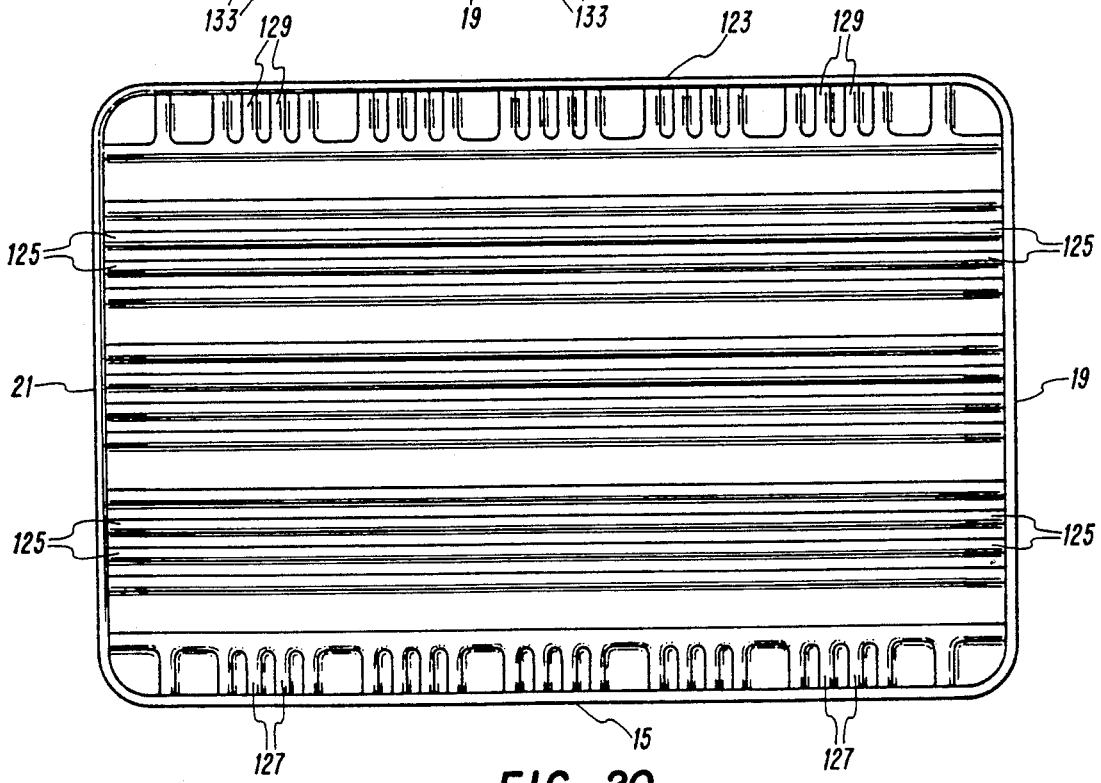

Referring to FIGS. 18–20, a sixth embodiment of a tray 121 according to the present invention is depicted. Tray 121 is substantially the same as tray 101, described above with reference to FIGS. 14–17, except that tray 121 includes a rim member 123 extending inwardly around the perimeter of tray 121 and has "compound" walls wherein respective lower portions 41 thereof are oriented substantially vertically and respective upper portions 43 thereof are angled outwardly with respect to a vertical axis to provide a predetermined draft angle.

Tray 121 further includes fourth, fifth and sixth sets of rib members 125, 127 and 129 disposed at substantially equal intervals between respective adjacent cooperating pairs of first, second and third sets of rib members 103, 105 and 107. Fourth set of rib members 125 extends vertically along substantially the entire height of first end wall 19, longitudinally along bottom member 13 and vertically along substantially the entire height of second end wall 21. Fifth and sixth sets of rib members 127 and 129 extend vertically along substantially the entire heights of respective first and second side walls 15 and 17 and partially inwardly across bottom member 13 and terminate at respective intersections on bottom member 13 with the respective ones of first set of rib members 103 which are closest to respective first and second side walls 15 and 17. Rim member 123 and fourth, fifth and sixth rib members 125, 127 and 129 define corresponding sets of grooves 131, 133 and 135 in the respective outer surfaces of tray 121.

Figure 21:
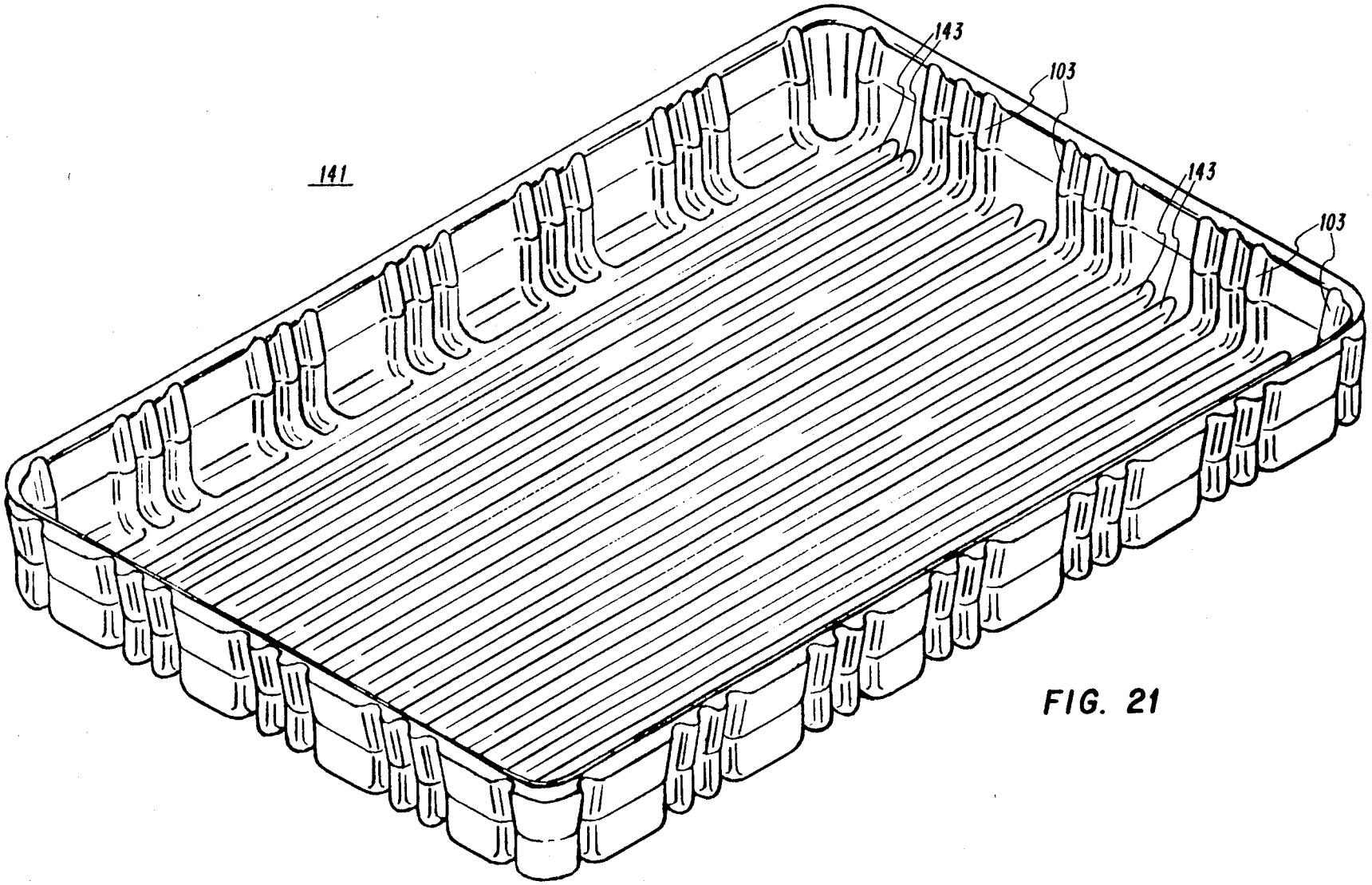
FIG. 21 is a perspective view of a seventh embodiment of the tray, according to the present invention.

Referring to FIG. 21, a seventh embodiment of a tray 141 according to the present invention is depicted. Tray 141 is substantially the same as tray 121, described above with reference to FIGS. 18–20, except that tray 141 further includes a seventh set of rib members 143 extending longitudinally along bottom member 13 between first and second end walls 19 and 21. Seventh set of rib members 143 are disposed between individual ones of each cooperating pair of first rib members 103, for dividing the corresponding recessed regions 109 between cooperating pairs of first rib members 103 into substantially equal sub-regions along bottom member 13. Seventh rib members 143 do not extend vertically along respective end walls 19 and 21, but rather terminate at the respective intersections with end walls 19 and 21. Seventh rib members 143 define a corresponding seventh set of grooves 145 in the respective outer surfaces of tray 141.

Figure 22:
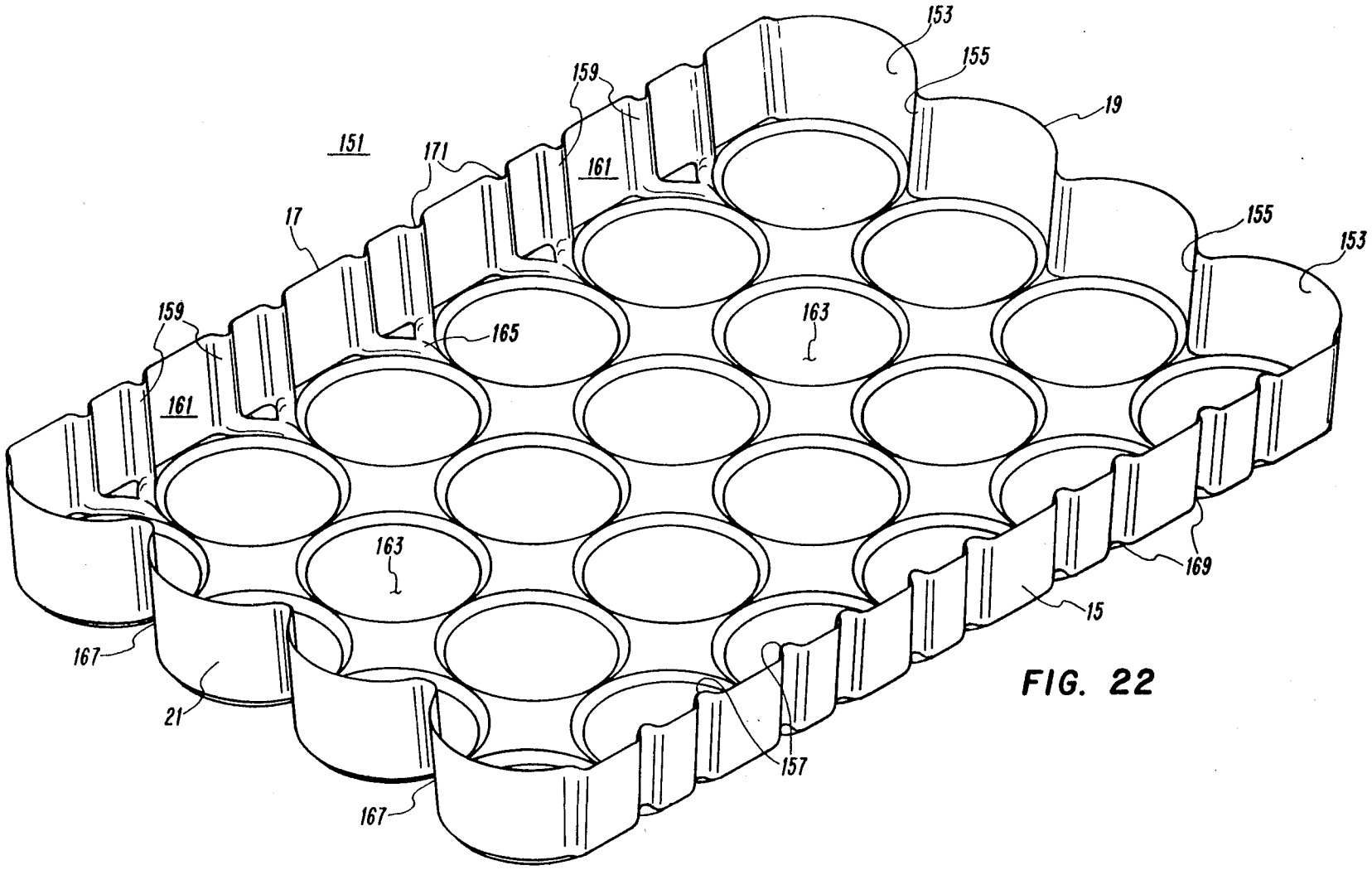
FIG. 22 is a perspective view of an eighth embodiment of the tray, according to the present invention.
Figure 31:
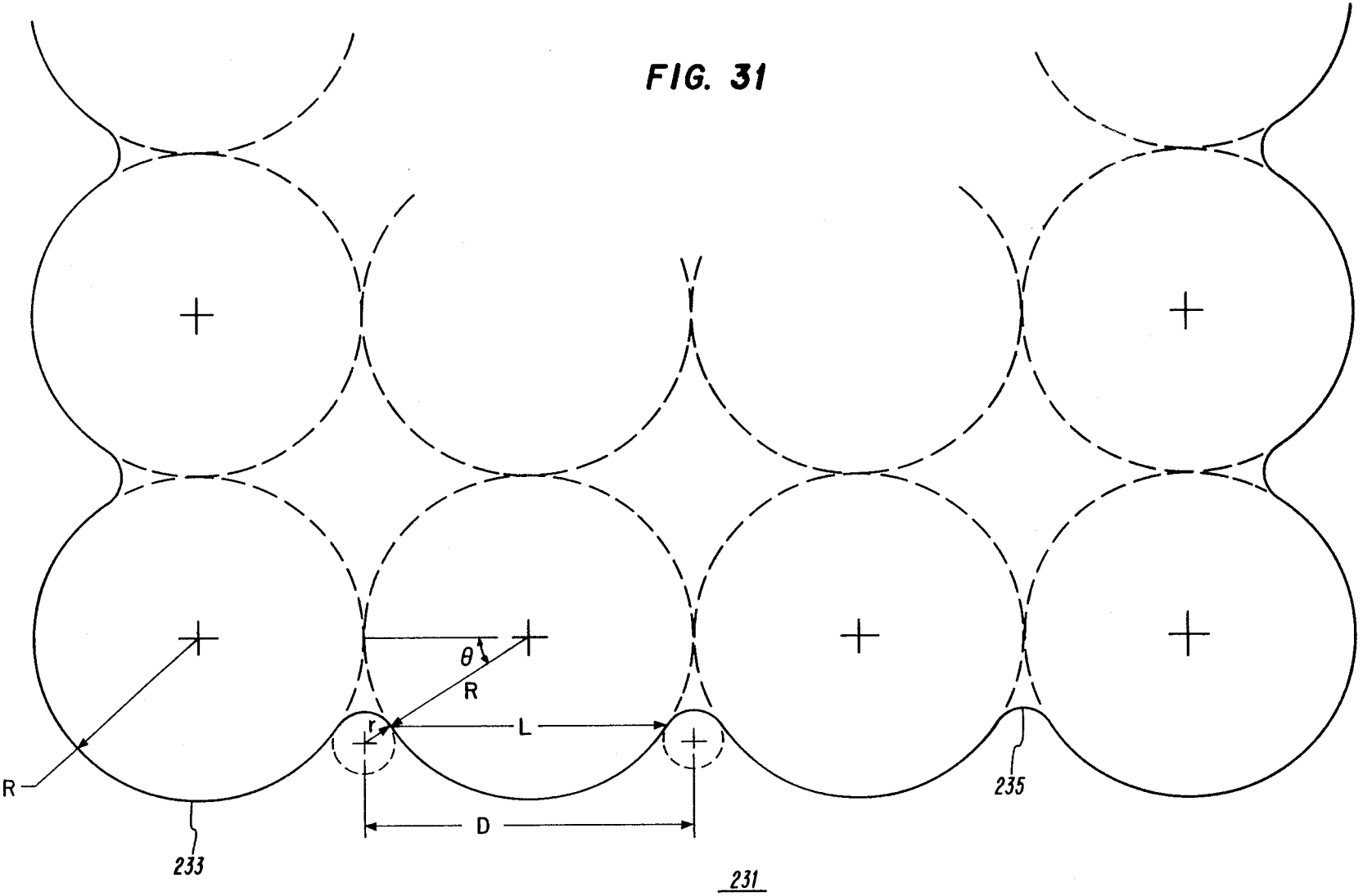

Referring to FIG. 22, an eighth embodiment of a tray 151 according to the present invention is depicted. First and second end walls 19 and 21 are comprised of a plurality of recessed regions 153 separated by corresponding ones of a plurality of inwardly extending surfaces 155 to provide a substantially scalloped appearance on end walls 19 and 21. The end wall surface within each recessed region 153 is curved to conform to the curved surface of the corresponding article which is to be stored and transported within tray 151, so that substantially the entire curved surface of the portion of the article which is disposed within the corresponding recessed region 153 is in contact with the end wall surface within each region 153, as best seen in FIG. 31.

First and second side walls 15 and 17 have respective first and second sets of rib members 157 and 159 extending vertically along substantially the entire height of the respective side walls 15 and 17 and partially inwardly across bottom member 13. Selected ones of first and second sets of rib members 157 and 159 are arranged in cooperating pairs to define respective recessed regions 161 therebetween.

Bottom member 13 includes a plurality of receptacles 163, which are preferably circularly shaped to conform to the cylindrical shape of the articles which are stored and transported within tray 151. The portion of bottom member 13 surrounding each receptacle 163 is beveled to substantially conform to the beveled shape of the chine portion of a typical beverage can which is loaded into tray 151. Individual rib members 157 and 159 in each cooperating pair diverge away from one another along bottom member 13 so that at least a portion of a corresponding receptacle 163 is received within the corresponding recessed region 161 defined by each cooperating pair of rib members. Similarly, the individual rib members 157 and 159 in each cooperating pair converge toward the respective adjacent rib members 157 and 159 on opposite sides of the corresponding recessed region 161, so that the individual rib members in each cooperating pair intersect with respective adjacent rib members between respective adjacent receptacles 163, as indicated at 165. Side walls 15 and 17 and end walls 19 and 21 are oriented substantially vertically with respect to bottom member 13 so that walls 15, 17, 19 and 21 have negligible draft angle. Inwardly extending surfaces 155 and first and second sets of rib members 157 and 159 form respective grooves 167, 169 and 171 in the corresponding outer surfaces of tray 151.

Figure 23:
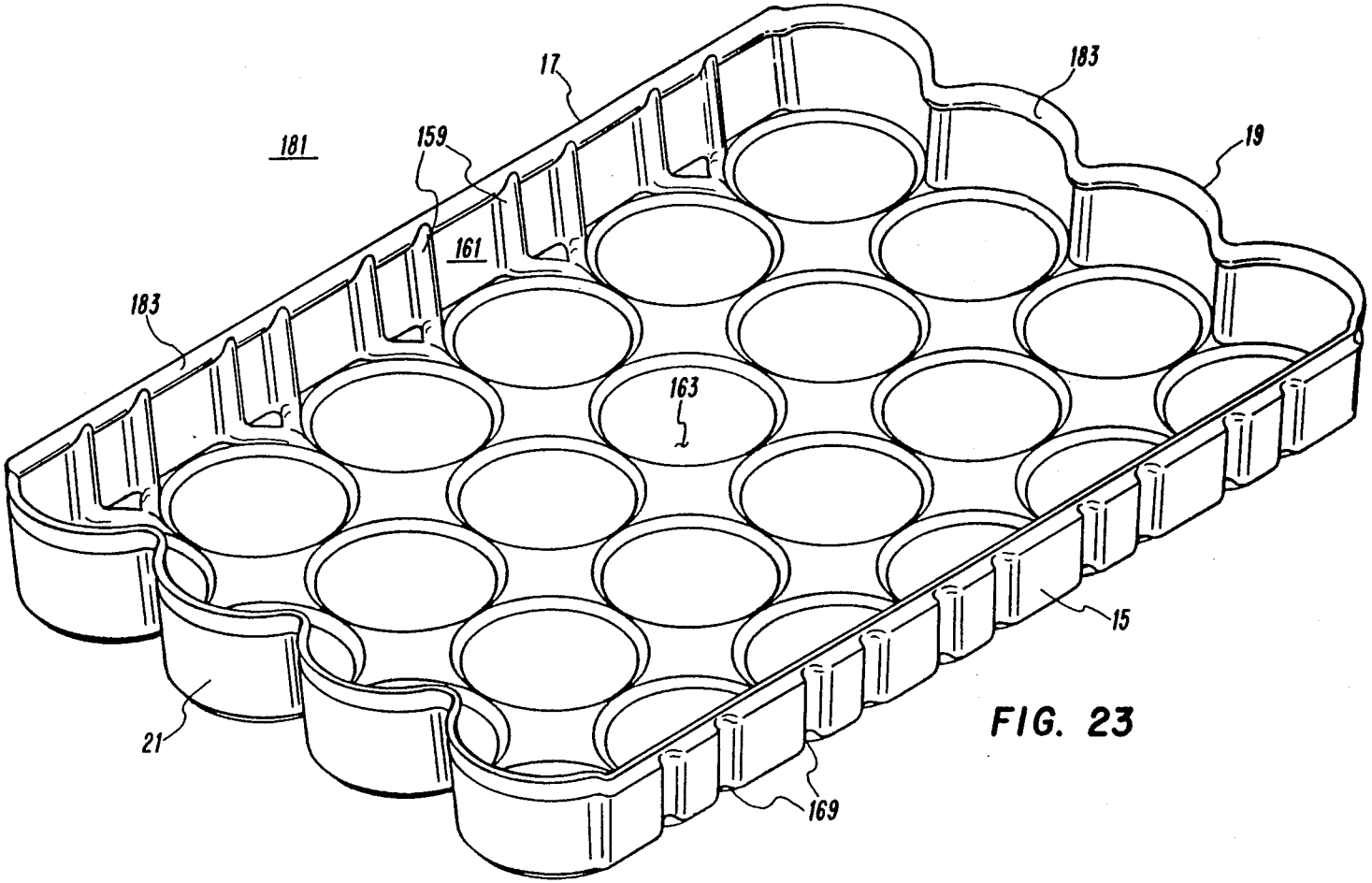
FIG. 23 is a perspective view of a ninth embodiment of the tray, according to the present invention.

Referring to FIG. 23, a ninth embodiment of a tray 181 is depicted. Tray 181 is substantially the same as tray 151, described above with reference to FIG. 22, except that tray 181 includes a rim member 183 extending inwardly adjacent to the upper edge of tray 181 around the perimeter thereof. Rim member 183 forms a corresponding groove in the respective outer surfaces of tray 181.

Figure 24:
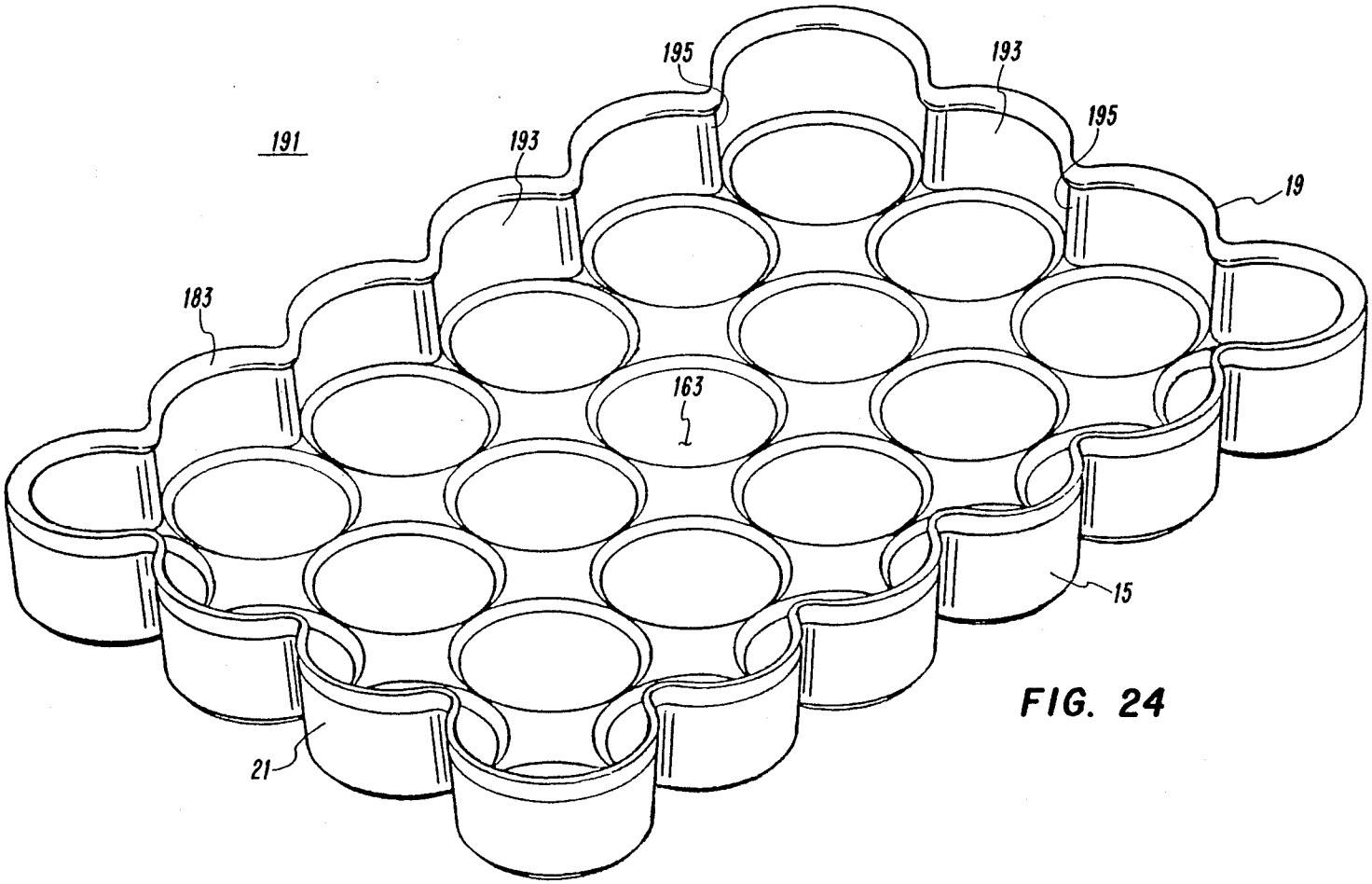
FIG. 24 is a perspective view of a tenth embodiment of the tray, according to the present invention.

Referring to FIG. 24, a tenth embodiment of a tray 191 according to the present invention is depicted. Each of the four walls 15, 17, 19 and 21 of tray 191 is comprised of a plurality of recessed regions 193 separated by corresponding ones of a plurality of inwardly extending surfaces 195, to provide a substantially scalloped appearance on all four walls of tray 191. Otherwise, tray 191 is substantially the same as tray 181, described above with reference to FIG. 23.

Figure 25:
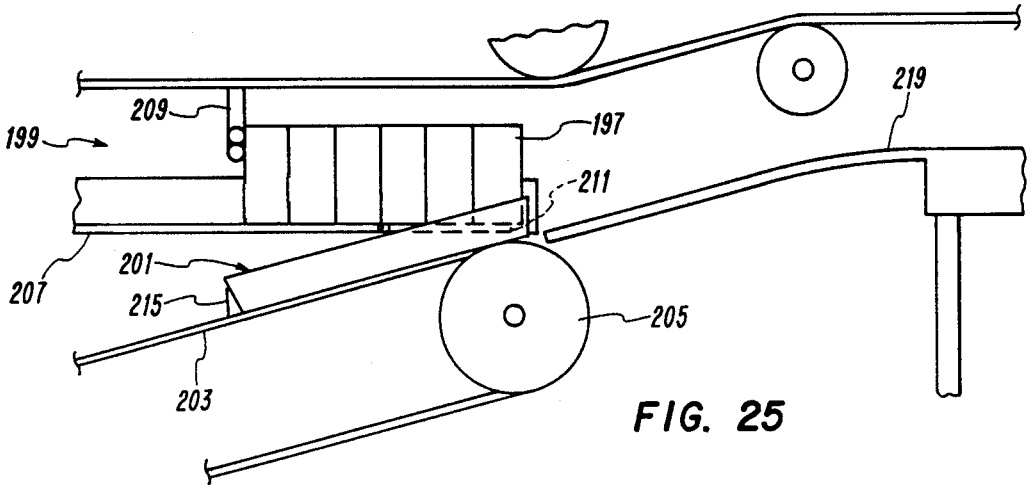
FIGS. 25–27 are side elevation views of a portion of a tray packing system, illustrating the successive steps in which articles are loaded into the tray.
Figure 26:
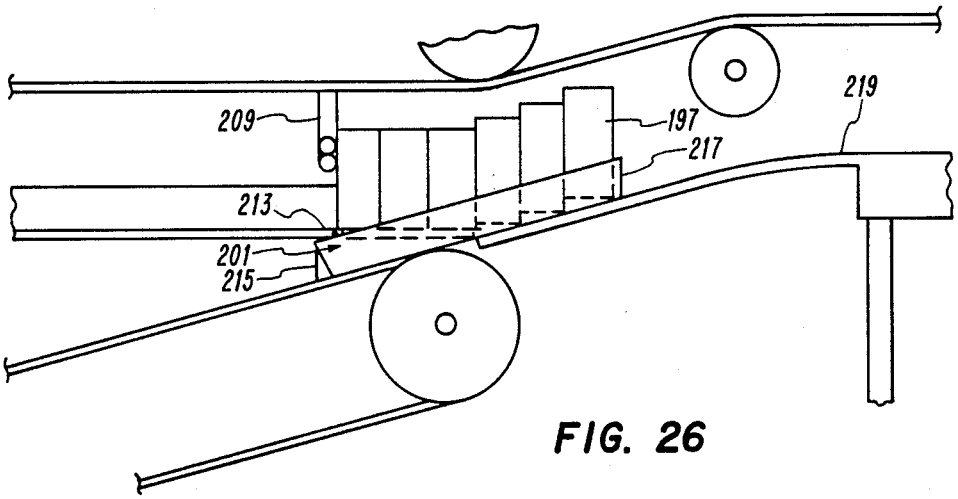
Figure 27:
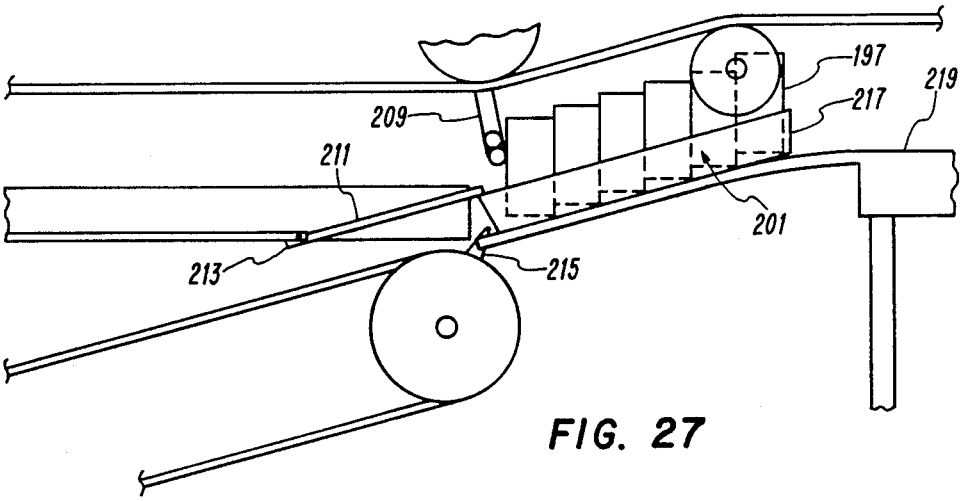

Referring to FIGS. 25–27, the process by which articles, such as beverage containers, are loaded into the transport and storage tray according to the present invention is depicted. A plurality of beverage containers 197 are transported along a first conveyor track 199. Containers 197 are typically grouped into groups of twenty-four individual containers 197 corresponding to a standard case of beverage containers. In FIGS. 25–27, six rows of containers 197, each row having four containers 197, are shown.

Tray 201 in transported along a second conveyor track 203, which isinclined at an angle with respect to first conveyor track 199. Second conveyor track 203 is preferably comprised of a conveyor belt, which is wound around two opposed drive drums or pulleys 205 (only one of which is shown in FIGS. 25–27) to form a continuous loop. First conveyor track 199 is preferably comprised of a relatively stationary track 207, which journally supports articles 197, and a continuous loop chain and sprocket arrangement on which a plurality of flight bars 209 are disposed. Flight bars 209 engage the trailing row of containers 197 to propel containers 197 along stationary track 207.

A ramp member 211 is pivotally attached at the downstream end of stationary track 207 and is mounted so as to be rotatable in an upward direction about an axis extending laterally across stationary track 207. Ramp member 211 includes an extension portion 213, which engages the under-surface of stationary track 207 to act as a stop and prevent ramp member 211 from being rotated substantially below a horizontal position at the level of stationary track 207. Each case of containers 197 is pushed off ramp 211 by the corresponding flight bar 209 into the corresponding tray 201. As each tray 201 moves up second conveyor track 203, the trailing edge 215 of the corresponding tray 201 that is being filled will contact ramp member 211, causing ramp member 211 to pivot upwardly to allow tray 201 to continue its upward movement along second conveyor track 203.

Referring specifically to FIG. 25, when the downstream end of ramp member 211 clears leading edge 217 of tray 201, ramp member 211 will return to a substantially horizontal position. At this point, the leading row of containers 197 has reached the upstream edge of extension portion 213 of ramp member 211. When tray 201 is in position on second conveyor track 203 to receive containers 197, the leading row of containers 197 is loaded into tray 201. The leading row is maintained in a substantially vertical orientation and is sandwiched between the leading edge 217 of tray 201 and the second row of containers 197. The bottom surface of tray 201 is oriented at a substantially acute angle with respect to the corresponding bottom surfaces of containers 197, so that containers 197 appear to be "leaning forward" with respect to the bottom surface of tray 201. The second and third rows of containers 197 are loaded into tray 201 in substantially the same manner, as shown in FIGS. 26 and 27, as flight bar 209 continues to push containers 197 downstream along stationary track 207 and the corresponding tray 201 continues its upward movement along second conveyor track 203.

Referring specifically to FIG. 27, ramp member 211 will begin to move upwardly again as it comes into contact with trailing edge 215 of tray 201. Thus, the fourth, fifth and sixth rows of containers 197 will be pushed off the front edge of ramp 211 by flight bar 209 and slide a short distance downward into tray 201. After tray 201 has been filled with containers 197, each container 197 is in contact with the corresponding adjacent containers 197 in all directions and the containers 197 on the outside of the configuration will be in contact with the corresponding adjacent walls of the tray to achieve a tightly packed configuration with virtually no wasted space. An automated system for packing beverage containers and the like into a transport tray according to the present invention is described in greater detail in co-pending patent application Ser. No. 889,734, filed by Applicant on July 28, 1986 now Pat. No. 4,704,841.

One skilled in the art will appreciate that any of the embodiments of the storage and transport tray according to the prevent invention, as described above with reference to FIGS. 1–21, may be used in connection with the packing process described above with reference to FIGS. 25–27. The outwardly sloping wall of tray 201 provides a draft angle, which increases the effective length of tray 201 when the tray is packed at an angle and facilitates the loading of containers 197 into tray 201. After containers 197 are loaded into tray 201, the loaded tray is transported along a third, substantially horizontal, conveyor track 219. When tray 201 reaches a substantially horizontal position, articles 197 will "rock back" gently within tray 201 to achieve a stable, upright position for further transport. When containers 197 are in a stable, upright position, only the "chine" portion of each container 197 is in contact with the corresponding rib members and with the wall between the corresponding rib members because of the draft angle of tray 201 which causes the walls to slope upwardly and away from containers 197. The bottom portion of each container 197 rests upon the corresponding rib members disposed on the bottom surface of tray 201.

Figure 28:
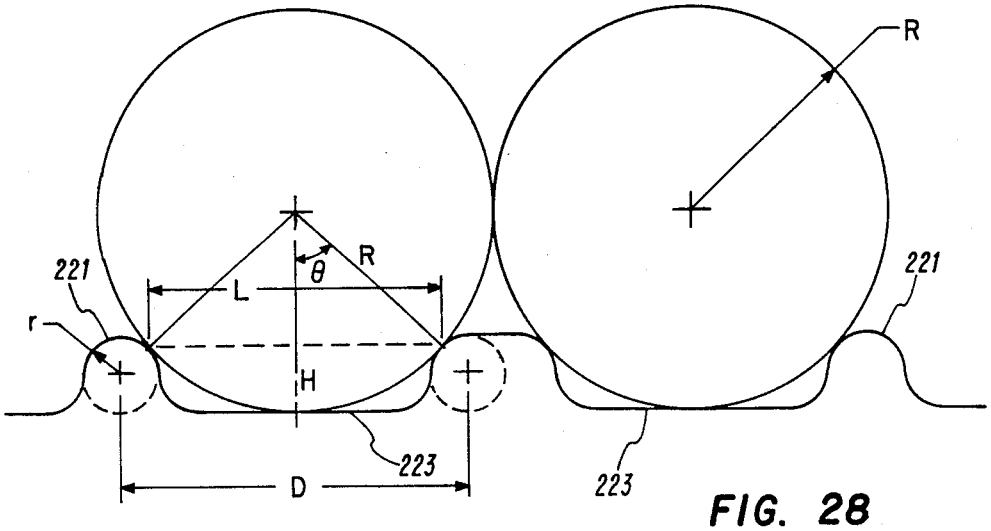
FIGS. 28–31 are top plan views illustrating the contact between the articles loaded into the tray and the walls of the tray, according to the present invention.
Figure 29:
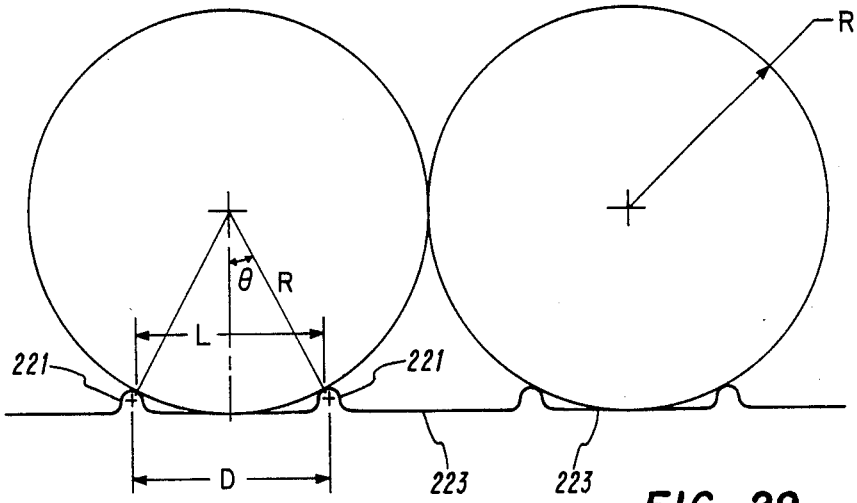
Figure 30:
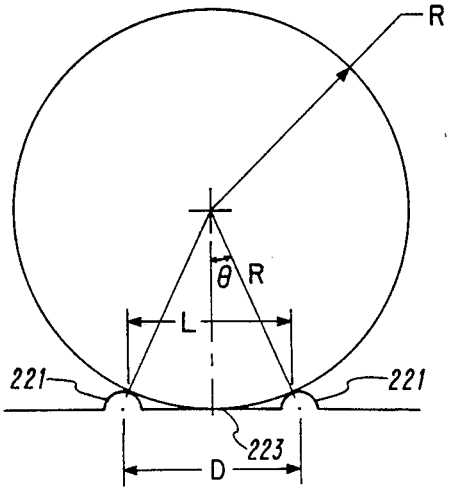

Referring to FIGS. 28–30, the respective points of contact between each article 197 and the corresponding rib members 221 and wall 223 of tray 201 are depicted. In FIGS. 28 and 29, the curvature of each rib member 221 is such that an imaginary circle is transcribed by a cross-section of each rib member 221, taken horizontally along an axis perpendicular to the corresponding wall 223. The imaginary circle is tangent to the plane of the particular wall 223 from which rib member 221 extends, as represented by the dotted curve. FIGS. 28 and 29 illustrate the dependency of the spacing between individual rib members 221 as a function of the "thickness" of rib members 221. Because of the curvilinear nature of rib members 221, it is convenient to represent the "thickness" thereof in terms of the radius of curvature r of rib members 221, as measured from the center of the imaginary circle. The radius of each cylindrical container 197 is represented by R. The lateral distance D between the respective centers of adjacent rib members 221 is represented geometrically as follows:

$$D=4\sqrt{rR}$$

The distance H between wall 223 and the point of tangency between container 197 and each rib member 221, as measured along an axis perpendicular with respect to wall 223, is represented by the following geometrical relationship:

$$H=2rR/(r+R)$$

The lateral distance L between points of tangency of each container 197 with adjacent rib members 221 of the corresponding cooperating pair of rib members, as measured parallel to the corresponding wall 223, is represented by the following geometrical relationship:

$$L=2R\sin\theta=Rd/2(R+r)$$

One skilled in the art will recognize that the spacing D between adjacent rib members 221 of each cooperating pair is proportional to the square root of the radius of curvature r of rib members 221. For example, in FIG. 29 the radius of curvature r of rib members 221 is substantially less than the corresponding radius of curvature r of rib members 221 in FIG. 28. Therefore, the distance D between the respective centers of adjacent rib members 221 is substantially less in FIG. 29 than in FIG. 28.

Referring to FIG. 30, rib members 221 have a semicircular shape. The geometric relationships D, H and L are expressed as follows as a function of the radius of curvature r of rib members 221 and the radius R of articles 197.

$$D=2\sqrt{r(2R+r)}$$

$$H=Rr/(R+r)$$

$$L=2R\sin\theta=RD/2(R+r)$$

Referring to FIG. 31, a tray 231 in which all four walls 233 are scalloped, as in FIG. 24, is depicted. In this case r represents the radius of curvature (as measured from the center of the imaginary circle represented by the dotted curve) of each inwardly extending portion 235 along each of the four walls 233. The spacing D between respective centers of adjacent ones of extension portions 235 along each wall 233 and the lateral distance L between the respective points of tangency of each container 197 with the respective extension portions 235 are represented by the following geometric relationship:

$$D=2R$$

$$L=2R\cos\theta=R^2/(r+R)$$

One skilled in the art will appreciate that when articles 197 are stored in tray 231, the spacing D between the respective centers of adjacent ones of extension portions 235 is solely dependent upon the radius R of each article 197. The lateral distance L between the respective points of tangency of each container 197 and the respective extension portions 235 decreases as the radius of curvature r increases.

Figure 32:
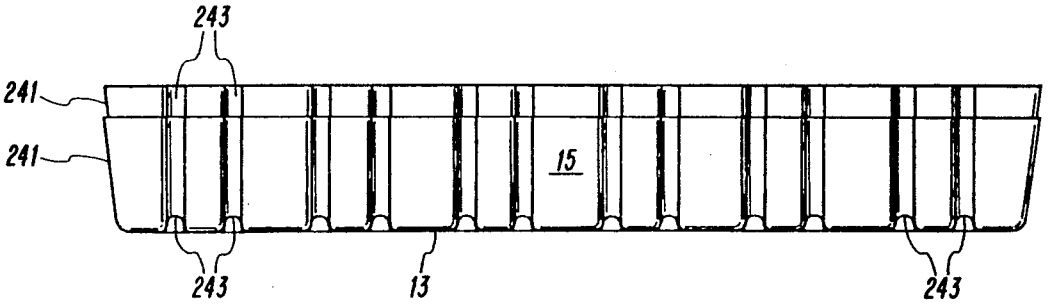
FIGS. 32 and 33 are side elevation and end elevation views, respectively, of two trays being nested together while empty, according to the present invention.
Figure 33:
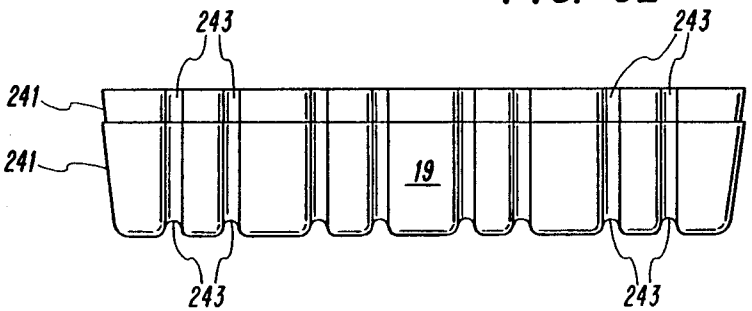
Figures 34, 35:
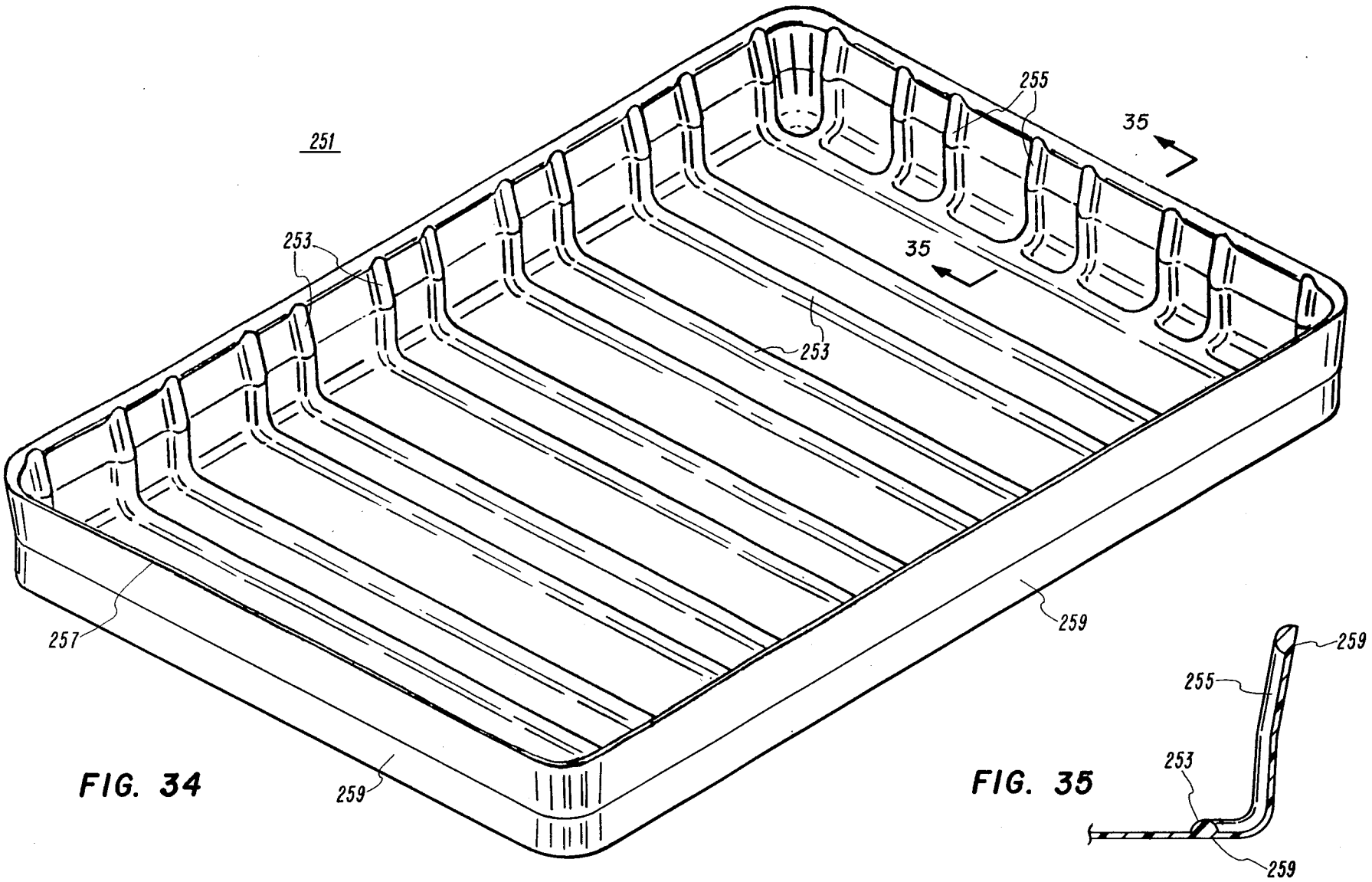
FIG. 34 is a perspective of an eleventh embodiment of the tray according to the present invention.
FIG. 35 is a sectional view of a portion of the tray, taken along the section line indicated in FIG. 34.
Figure 36:
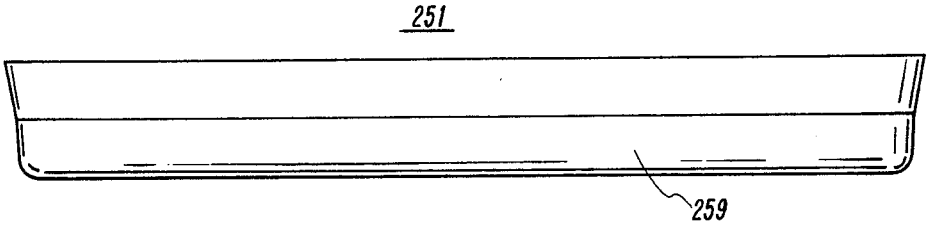
FIG. 36 is a side elevation view of the tray shown in FIG. 34.
Figure 37:
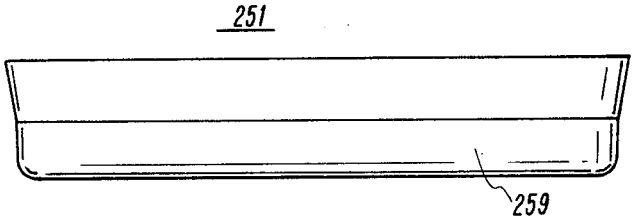
FIG. 37 is an end elevation view of the tray shown in FIG. 34.
Figure 38:
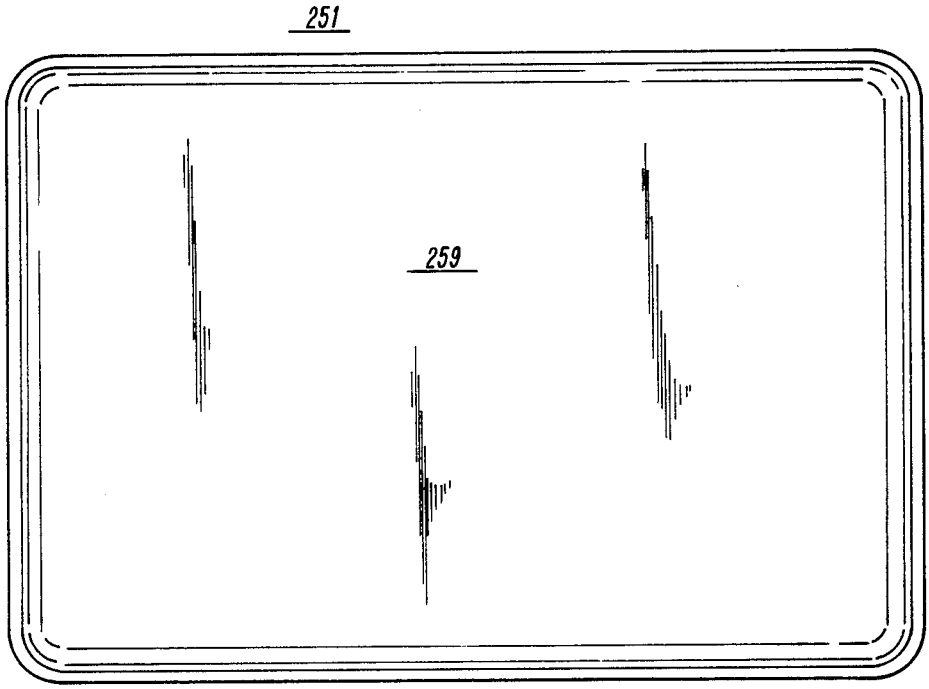
FIG. 38 is a bottom plan view of the tray shown in FIG. 34.

Another aspect of the invention is illustrated in FIGS. 32 and 33. Two trays 241 are nested together by inserting the bottom portion of a first one of trays 241 into the enclosure formed by the bottom member and four walls of a second tray 241. The draft angle of the walls of each tray 241 facilitates the nesting of trays 241. One skilled in the art will appreciate that grooves 243 defined by the corresponding rib members (not shown) on the outer surfaces of first tray 241 will mate with the complementary rib members on the inner surfaces of second tray 241 along the respective four walls of the two trays 241, to conserve storage space when the trays are not in use.

Referring to FIGS. 34–38, an eleventh embodiment of a tray 251 according to the present invention is depicted. Tray 251 is substantially the same as tray 11, described above with reference to FIGS. 1–4, except that first, second and third sets of rib members 253, 255 and 257 do not define corresponding grooves on the respective outer surfaces of tray 251. Rather, the respective outer surfaces of tray 251 are substantially smooth to enhance the structural integrity of the tray. When multiple trays filled with canned beverages are stacked one on top of the other, the rib members of the trays in the vicinity of the bottom of the stack, particularly the portions of the rib members formed on the respective bottom members of the trays, are subjected to large compressive forces. By forming the rib members on the inner surfaces of the tray to eliminate the corresponding grooves on the respective outer surfaces 259 so that respective outer surfaces 259 are substantially smooth, the structural strength of the rib members is substantially enhanced. One skilled in the art will appreciate that it is advantageous to eliminate the grooves on the outer surfaces opposite the respective rib members in all of the trays described above with references to FIGS. 1–23, so that the respective outer surfaces are substantially smooth.

Figure 39:
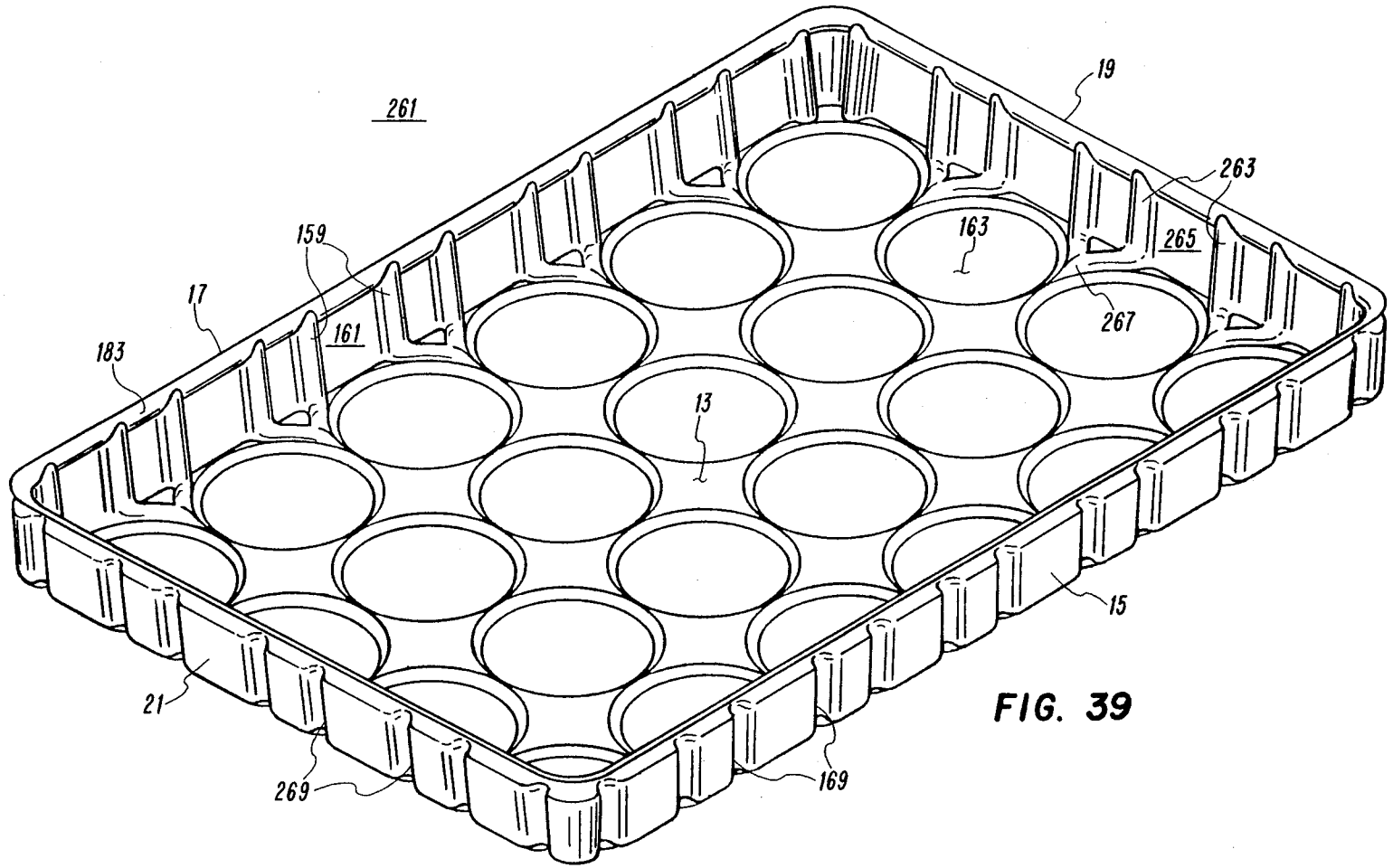
FIG. 39 is a perspective view of a twelfth embodiment of the tray according to the present invention.

Referring to FIG. 39, a twelfth embodiment of a tray 261 according to the present invention is depicted. Tray 261 is substantially the same as tray 181, described above with reference to FIG. 23, except that the scalloped surfaces comprising end walls 19 and 21 of tray 181 are replaced with relatively flat wall surfaces having respective third and fourth sets of rib members 263 disposed on respective inner surfaces thereof. Only the third set of rib members 263 is shown in FIG. 39.

Third and fourth sets of rib members 263 extend vertically along substantially the entire height of the respective end walls 19 and 21 and partially inwardly along bottom member 13. Selected ones of third and fourth sets of rib members 263 are arranged in cooperating pairs to define respective recessed regions 265 therebetween. Individual rib members 263 in each cooperating pair diverge away from one another along bottom member 13 so that at least a portion of the corresponding receptacle 163 is received within the corresponding recessed region 265 defined by each cooperating pair or rib members 263. Similarly, individual rib members 263 in each cooperating pair converge toward the respective adjacent rib members 263 on opposite sides of the corresponding recessed region 265, so that individual rib members in each cooperating pair intersect with respective adjacent rib members between respective adjacent receptacles 163, as indicated at 267. Third and fourth sets of rib members 263 define respective grooves 269 on the respective outer surfaces of end walls 19 and 21 of tray 261. Only grooves 269 associated with fourth set of rib members 263 are shown in FIG. 39.

The tray according to the present invention provides a cost effective, returnable tray for storing and transporting cylindrically shaped articles, such as beverage containers. The tray is lightweight, but sturdy and is able to store and transport beverage containers in either a loose state or in multi-container packages, such as in packages of six, eight or twelve individual containers. The nestability feature of the trays allows multiple trays to be stored in a minimum of storage space when not in use. The tray is integrally formed to retain fluid leaks and spills so as to prevent contamination of the contents of other trays. The storage and transport tray according to the present inventon is well-suited for use in connection with automated tray packing systems of various types, including vertical drop packers and packers in which the beverage containers are loaded into the tray at an angle, as described in co-pending patent application Ser. No. 889,734, filed on July 28, 1986 now Pat. No. 4,704,841.

Various embodiments of the invention have now been described in detail. Since it is obvious that changes in and modifications to the above-described preferred embodiment may be made without departing from the nature, spirit and scope of the present invention, the invention is not to be limited to said details, except as set forth in the appended claims.

What is claimed is:

1. A tray for storing and transporting a plurality of cylindrically-shaped articles in a substantially upright position, said tray comprising:

a bottom member, a pair of oppositely positioned first and second side walls extending longitudinally along said tray and a pair of oppositely positioned first and second end walls extending transversely across said tray, said bottom member and said walls being interconnected to define an enclosure for receiving said articles;

each of said first and second end walls being comprised of a first plurality of recessed regions separated by corresponding ones of a plurality of inwardly extending surfaces to provide a substantially scalloped appearance on said end walls, the end wall surface within each region being curved to conform to the curved surface of the corresponding article so that substantially the entire curved surface of the portion of the article which is disposed within the recessed region is in contact with the end wall surface within each region;

said first and second side walls having respective first and second sets of rib members extending vertically along sustantially the entire height of the respective side walls and partially inwardly across said bottom member on respective inner surfaces thereof, selected ones of said first and second sets of rib members being arranged in cooperating pairs to define a second plurality of recessed regions therebetween;

the respective outer surfaces of said first and second side walls and said bottom member being substantially smooth to enhance the structural integrity of the tray;

said bottom member having a plurality of receptacles disposed therein for receiving predetermined lower portions of corresponding ones of said articles when said articles are disposed within said tray in a substantially upright position, each of said receptacles having a substantially circular shape to conform to the cylindrical shape of said articles, a portion of said bottom member surrounding each of said receptacles being beveled to substantially conform to the chine portion of the corresponding article received within the receptacle.

2. The tray according to claim 1 wherein the rib members in each cooperating pair diverge away from one another along the bottom member so that at least a portion of the corresponding receptacle is received within the corresponding recessed region defined by each cooperating pair of rib members, the rib members in each cooperating pair converging toward the respective adjacent rib members on opposite sides of the corresponding recessed region so that the rib members in each cooperating pair intersect with respective adjacent rib members substantially between respective adjacent receptacles.

3. A tray for storing and transporting a plurality of cylindrically-shaped articles in a substantially upright position, said tray comprising:

a bottom member, a pair of oppositely positioned first and second side walls extending longitudinally along said tray and a pair of oppositely positioned first and second end walls extending transversely across said tray, said bottom member and said walls being interconnected to define an enclosure for receiving said articles;

a first set of rib members extending vertically at least partially along the height of said first side wall, transversely across said bottom member and vertically at least partially along the height of the second side wall on respective inner surfaces thereof;

second and third sets of rib members extending vertically at least partially along the heights of the respective first and second end walls and partially inwardly along said bottom member on respective inner surfaces thereof and terminating at respective intersections on said bottom member with respective ones of said first set of rib members which are closest to the respective first and second end walls, selected ones of said first, second and third sets of rib members being arranged in cooperating pairs to define respective recessed regions therebetween, each of said cooperating pairs for contacting a corresponding one of the articles at respective positions on the curved surfaces thereof so that a predetermined portion of each article is received within the corresponding recessed region and at least a portion of the curved surface of the article is in contact with the corresponding wall within the recessed region, thereby retaining the articles in a substantially upright position within the tray, the spacing between the rib members in each cooperating pair being sufficient to allow the curved surface of the corresponding article which is received within the corresponding recessed region to contact the corresponding pair of rib members at respective first and second points of tangency and to contact the corresponding wall of the tray within the corresponding region at a third point of tangency, the respective outer surfaces of said walls and said bottom member being substantially smooth to enhance the structural integrity of the tray; and a fourth set of rib members extending vertically at least partially along the height of said first side wall, transversely across said bottom member and vertically at least partially along the heights of said second side wall on respective inner surfaces thereof, and fifth and sixth sets of rib members extending vertically at least partially along the height of the respective first and second end walls and partially inwardly along said bottom member on respective inner surfaces thereof and terminating at respective intersections on said bottom member with respective ones of said first set of rib members which are closest to the respective first and second end walls, said fourth, fifth and sixth sets of rib members being disposed at substantially equal intervals between adjacent recessed regions on the respective walls of the tray.

4. The tray according to claim 3 further including a seventh set of rib members extending transversely across said bottom member between first and second side walls on an inner surface of said bottom member, said seventh set of rib members being disposed between respective cooperating pairs of said first set of rib members.

5. A tray for storing and transporting a plurality of cylindrically-shaped articles in a substantially upright position, said tray comprising:

a bottom member, a pair of oppositely positioned first and second side walls extending longitudinally along said tray and a pair of oppositely positioned first and second end walls extending transversely across said tray, which are interconnected to provide an enclosure for receiving said articles;

a first set of rib members extending vertically at least partially along the height of the first end wall, longitudinally along said bottom member and vertically at least partially along the height of the second end wall on respective inner surfaces thereof;

second and third sets of rib members extending vetically at least partially along the heights of the respective first and second side walls and partially inwardly along said bottom member on respective inner surfaces thereof and terminating at respective intersections on said bottom member with respective ones of said first set of rib members which are closest to the respective first and second side walls, selected ones of said first, second and third sets of rib members being arranged in cooperating pairs to define a plurality of respective recessed regions therebetween, each of said cooperating pairs for contacting a corresponding one of said articles at respective positions on the curved surfaces thereof so that a predetermined portion of each article is received within the corresponding recessed region and at least a portion of the curved surface of the article is in contact with the corresponding wall within the recessed region, thereby retaining the articles in a substantially upright position within the tray, the spacing between rib members in each cooperating pair being sufficient to allow the curved surface of the corresponding article which is received within the corresponding recessed region to contact the corresponding cooperating pair of rib members at respective first and second points of tangency and to contact the corresponding wall of the tray within the corresponding recessed region at a third point of tangency, respective outer surfaces of said bottom member and walls being substantially smooth to enhance the structural integrity of the tray; and a fourth set of rib members extending vertically at least partially along the height of the first end wall, longitudinally along the bottom member and vertically at least partially along the height of the second end wall on respective inner surfaces thereof, and fourth and fifth sets of rib members extending vertically at least partially along the height of the respective first and second side walls and partially inwardly across said bottom member on respective inner surfaces thereof and terminating at respective intersections on said bottom member with respective ones of said first set of rib members which are closest to the respective first and second side walls, said fourth, fifth and sixth sets of rib members being disposed at substantially equal intervals between adjacent recessed regions on the respectie walls of the tray.

6. The tray according to claim 5 further including a seventh set of rib members extending longitudinally along said bottom member on an inner surface thereof between the first and second end walls, said seventh set of rib members being disposed between respective cooperating pairs of said first set of rib members within the corresponding recessed regions.

7. A tray for storing and transporting a plurality of cylindrically-shaped articles in a substantially upright position, said tray comprising:

a bottom member, a pair of oppositely positioned first and second side walls extending longitudinally along said tray and a pair of oppositely positioned first and second end walls extending tranversely across said tray, said bottom member and said walls being interconnected to define an enclosure for receiving said articles;

first and second sets of rib members extending vertically along substantially the entire height of the respective first and second side walls and partially inwardly across said bottom member on respective inner surfaces thereof, selected ones of said first and second sets of rib members being arranged in respective cooperating pairs to define a first plurality of recessed regions therebetween;

third and fourth sets of rib members extending vertically along substantially the entire height of the respective first and second end walls and partially inwardly along said bottom member on respective inner surfaces thereof, selected ones of said third and fourth sets of rib members being arranged in respective cooperating pairs to define a second plurality of recessed regions therebetween;

a plurality of receptacles disposed on said bottom member for receiving predetermined lower portions of corresponding ones of said articles when said articles are disposed within said tray in a substantially upright position, each of said receptacles having a substantially circular shape to conform to the cylindrical shape of said articles, a portion of said bottom member surrounding each of said receptacles being beveled to substantially conform to the chine portion of the corresponding article received within the receptacle.

8. The tray according to claim 7 wherein the rib members in each cooperating pair diverge away from one another along the bottom member so that at least a portion of the corresponding receptacle is received within the corresponding recessed region defined by each cooperating pair of rib members, the rib members in each cooperating pair converging toward the adjacent rib members on opposite sides of the corresponding recessed region so that the rib members in each cooperating pair intersect with respective adjacent rib members substantially between respective adjacent receptacles.

9. A tray for storing and transporting a plurality of substantially cylindrically-shaped articles in a substantially upright position, each of said articles having a substantially circular lateral cross-section, said tray comprising:

a bottom member, a pair of oppositely positioned first and second side walls extending longitudinally along said tray and a pair of oppositely positioned first and second end walls extending transversely across said tray, said bottom member and said walls being interconnected to define an enclosure for receiving said articles;

each of said first and second end walls being comprised of a first plurality of recessed regions separated by corresponding ones of a plurality of inwardly extending surfaces to provide a substantially scalloped appearance on said end walls, the end wall surface within each region being curved to conform to the curved surface of the corresponding article, so that substantially the entire curved surface of the portion of the article which is disposed within the recessed region is in contact with the end wall surface within each region;

said first and second side walls having respective first and second sets of rib members extending vertically along substantially the entire height of the respective side walls and partially inwardly across said bottom member on respective inner surfaces thereof, each rib member of the first and second sets of rib members for cooperating with at least one other rib member of the same set to define a corresponding second recessed region between each pair of cooperating rib members, the rib members of each cooperating having a predetermined curvature for contacting a corresponding one of said articles at respective first and second points of tangency on the curved surface thereof so that a predetermined portion of the article is received within the corresponding recessed region thereby retaining the articles in a substantially upright position within the tray;

said bottom member having a plurality of receptacles disposed therein for receiving predetermined lower portions of corresponding ones of said articles when said articles are disposed within said tray in a substantially upright position, each of said articles having a substantially circular shape to conform to the cylindrical shape of said articles, the lower portion of said bottom member surrounding each of said receptacles being beveled to substantially conform to the chine portion of the corresponding article received within the receptacle.

10. The tray according to claim 9 wherein the rib members in each cooperating pair diverge away from one another along the bottom member so that at least a portion of the corresponding receptacle is received within the corresponding recessed region defined by each cooperating pair of rib members, the rib members in each cooperating pair converging toward the respective adjacent rib members on opposite sides of the corresponding recessed region so that the rib members in each cooperating pair intersect with respective adjacent rib members substantially between respective adjacent receptacles.

* * * * *